US006964725B2

(12) United States Patent
Shannon et al.

(10) Patent No.: US 6,964,725 B2
(45) **Date of Patent: *Nov. 15, 2005**

(54) SOFT TISSUE PRODUCTS CONTAINING SELECTIVELY TREATED FIBERS

(75) Inventors: Thomas Gerard Shannon, Neenah, WI (US); James Daniel Lorenz, Greenville, WI (US); David Andrew Moline, Appleton, WI (US); Troy Michael Runge, Neenah, WI (US); Thomas Hampshire Schulz, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 36 days.

This patent is subject to a terminal disclaimer.

(21) Appl. No.: 10/289,835

(22) Filed: Nov. 6, 2002

(65) Prior Publication Data

US 2004/0084165 A1 May 6, 2004

(51) Int. Cl.[7] ..... D21H 11/16; D21H 27/38

(52) U.S. Cl. ..... 162/127; 162/109; 162/129; 162/130; 162/141; 162/149; 162/158; 162/164.4; 162/182; 162/183

(58) Field of Search ..... 162/9, 109, 111, 162/112, 123, 129, 127, 128, 141, 130, 149, 158, 164, 4, 182, 183

(56) References Cited

U.S. PATENT DOCUMENTS

| | | | |
|---|---|---|---|
| 2,345,543 | A | 3/1944 | Wohnsiedler et al. |
| 2,926,116 | A | 2/1960 | Keim |
| 2,926,154 | A | 2/1960 | Keim |
| 3,556,932 | A | 1/1971 | Coscia et al. |
| 3,556,933 | A | 1/1971 | Williams et al. |
| 3,695,269 | A | 10/1972 | Malaney |
| 3,700,623 | A | 10/1972 | Keim |
| 3,722,469 | A | 3/1973 | Bartley et al. |
| 3,772,076 | A | 11/1973 | Keim |
| 3,838,692 | A | 10/1974 | Levesque |
| 3,849,241 | A | 11/1974 | Butin et al. |
| 3,855,158 | A | 12/1974 | Petrovich et al. |
| 3,865,078 | A | 2/1975 | De Howitt et al. |
| 3,879,257 | A | 4/1975 | Gentile et al. |
| 3,885,158 | A | 5/1975 | Flutie et al. |
| 3,899,387 | A | 8/1975 | Freis et al. |
| 3,899,388 | A | 8/1975 | Petrovich et al. |
| 3,905,329 | A | 9/1975 | Cone et al. |
| 3,930,465 | A | 1/1976 | Schuierer |
| 4,005,028 | A | 1/1977 | Heckert et al. |
| 4,005,030 | A | 1/1977 | Heckert et al. |
| 4,016,831 | A | 4/1977 | James et al. |
| 4,023,526 | A | 5/1977 | Ashmus et al. |
| 4,061,001 | A | 12/1977 | Von Der Eltz et al. |
| 4,081,318 | A | 3/1978 | Wietsma |
| 4,089,296 | A | 5/1978 | Barchi |
| 4,099,913 | A | 7/1978 | Walter et al. |
| 4,100,324 | A | 7/1978 | Anderson et al. |
| 4,112,167 | A | 9/1978 | Dake et al. |
| 4,118,526 | A | 10/1978 | Gregorian et al. |
| 4,129,528 | A | 12/1978 | Petrovich et al. |
| 4,147,586 | A | 4/1979 | Petrovich et al. |
| 4,158,076 | A | 6/1979 | Wallsten |
| 4,159,355 | A | 6/1979 | Kaufman |
| 4,162,190 | A | 7/1979 | Ashworth |
| 4,184,914 | A | 1/1980 | Jenkins |
| 4,193,762 | A | 3/1980 | Namboodri |
| 4,198,316 | A | 4/1980 | Nahta |
| 4,222,921 | A | 9/1980 | Van Eenam |
| 4,230,746 | A | 10/1980 | Nahta |
| 4,237,818 | A | 12/1980 | Clifford et al. |
| 4,263,344 | A | 4/1981 | Radvan et al. |
| 4,276,339 | A | 6/1981 | Stoveken |
| 4,279,964 | A | 7/1981 | Heller |
| 4,287,251 | A | 9/1981 | King et al. |
| 4,288,475 | A | 9/1981 | Meeker |
| 4,297,860 | A | 11/1981 | Pacifici et al. |
| 4,305,169 | A | 12/1981 | Vidalis |
| 4,326,000 | A | 4/1982 | Roberts |
| 4,343,835 | A | 8/1982 | Jones et al. |
| 4,348,251 | A | 9/1982 | Pauls et al. |
| 4,364,784 | A | 12/1982 | Van Wersch et al. |
| 4,366,682 | A | 1/1983 | Keller |
| 4,377,615 | A | 3/1983 | Suzuki et al. |
| 4,384,867 | A | 5/1983 | Gruber |
| 4,385,954 | A | 5/1983 | Pauls et al. |
| 4,387,118 | A | 6/1983 | Shelton |

(Continued)

FOREIGN PATENT DOCUMENTS

| | | | |
|---|---|---|---|
| CA | 2059627 | A1 | 7/1992 |
| DE | 252 208 | A1 | 12/1987 |
| EP | 0 120 472 | A1 | 10/1984 |

(Continued)

OTHER PUBLICATIONS

Derwent World Patent Database abstract of JP 06–270361 A: Description of New OJI Paper Co. Ltd., "Strainer Bag."

Luo, Yingwu and F. Joseph Schork, "Emulsion Copolymerization of Butyl Acrylate With Cationic Monomer Using Interfacial Redox Initiator System," *Journal of Polymer Science: Part A: Polymer Chemistry*, vol. 39, 2001, pp. 2696–2709.

(Continued)

*Primary Examiner*—Peter Chin
(74) *Attorney, Agent, or Firm*—Gregory E. Croft; Patricia A. Charlier

(57) ABSTRACT

The present invention is a tissue product comprising at least one tissue sheet. Each tissue sheet comprises a first side and an opposing second side. At least one tissue sheet comprises selectively treated pulp fiber treated with at least one hydrophobic chemical additive distributed non-uniformly in the z-direction within the tissue sheet. The tissue sheet has a % z-directional hydrophobic chemical additive gradient between the first side of the tissue sheet and the second side of the tissue sheet of about 20% or greater.

40 Claims, 1 Drawing Sheet

U.S. PATENT DOCUMENTS

| | | | |
|---|---|---|---|
| 4,400,953 | A | 8/1983 | Driessen et al. |
| 4,402,200 | A | 9/1983 | Clifford et al. |
| 4,406,737 | A | 9/1983 | Latimer et al. |
| 4,408,996 | A | 10/1983 | Baldwin |
| 4,414,268 | A | 11/1983 | Baldwin |
| 4,425,186 | A | 1/1984 | May et al. |
| 4,425,372 | A | 1/1984 | Baldwin |
| 4,426,418 | A | 1/1984 | Coleman et al. |
| 4,432,833 | A | 2/1984 | Breese |
| 4,435,965 | A | 3/1984 | Sasseville et al. |
| 4,440,597 | A | 4/1984 | Wells et al. |
| 4,440,808 | A | 4/1984 | Mitter |
| 4,442,771 | A | 4/1984 | Mitter |
| 4,444,104 | A | 4/1984 | Mitter |
| 4,453,462 | A | 6/1984 | Mitter |
| 4,463,467 | A | 8/1984 | Gruber et al. |
| 4,463,583 | A | 8/1984 | Kruger et al. |
| 4,474,110 | A | 10/1984 | Rosner |
| 4,481,243 | A | 11/1984 | Allen |
| 4,497,273 | A | 2/1985 | Mitter |
| 4,498,318 | A | 2/1985 | Mitter |
| 4,501,038 | A | 2/1985 | Otting |
| 4,502,304 | A | 3/1985 | Hopkins |
| 4,514,345 | A | 4/1985 | Johnson et al. |
| 4,528,239 | A | 7/1985 | Trokhan |
| 4,529,480 | A | 7/1985 | Trokhan |
| 4,534,189 | A | 8/1985 | Clifford |
| 4,537,822 | A | 8/1985 | Nanri et al. |
| 4,551,199 | A | 11/1985 | Weldon |
| 4,552,778 | A | 11/1985 | Zimmer |
| 4,556,450 | A | 12/1985 | Chuang et al. |
| 4,557,218 | A | 12/1985 | Sievers |
| 4,559,162 | A | 12/1985 | Abel et al. |
| 4,559,243 | A | 12/1985 | Passler et al. |
| 4,562,097 | A | 12/1985 | Walter et al. |
| 4,571,360 | A | 2/1986 | Brown et al. |
| 4,576,112 | A | 3/1986 | Funger et al. |
| 4,581,254 | A | 4/1986 | Cunningham et al. |
| 4,588,457 | A | 5/1986 | Crenshaw et al. |
| 4,597,831 | A | 7/1986 | Anderson |
| 4,603,176 | A | 7/1986 | Bjorkquist et al. |
| 4,605,702 | A | 8/1986 | Guerro et al. |
| 4,610,915 | A | 9/1986 | Crenshaw et al. |
| 4,612,874 | A | 9/1986 | Mitter |
| 4,618,689 | A | 10/1986 | Traver et al. |
| 4,646,675 | A | 3/1987 | Arthur et al. |
| 4,655,056 | A | 4/1987 | Zeiffer |
| 4,665,723 | A | 5/1987 | Zimmer |
| 4,667,882 | A | 5/1987 | Pacifici |
| 4,699,988 | A | 10/1987 | Traver et al. |
| 4,731,092 | A | 3/1988 | Berendt |
| 4,734,100 | A | 3/1988 | Berendt et al. |
| 4,741,739 | A | 5/1988 | Berendt et al. |
| 4,762,727 | A | 8/1988 | Voswinckel |
| 4,773,110 | A | 9/1988 | Hopkins |
| 4,778,477 | A | 10/1988 | Lauchenauer |
| 4,792,619 | A | 12/1988 | Berendt et al. |
| 4,799,278 | A | 1/1989 | Beeh |
| 4,816,320 | A | 3/1989 | St. Cyr |
| 4,833,748 | A | 5/1989 | Zimmer et al. |
| 4,872,325 | A | 10/1989 | Moser et al. |
| 4,886,632 | A | 12/1989 | Van Iten et al. |
| 4,894,054 | A | 1/1990 | Miskinyar |
| 4,894,118 | A | 1/1990 | Edwards et al. |
| 4,905,545 | A | 3/1990 | Leising et al. |
| 4,911,956 | A | 3/1990 | Gabryszewski et al. |
| 4,912,948 | A | 4/1990 | Brown et al. |
| 4,919,877 | A | 4/1990 | Parsons et al. |
| 4,925,528 | A | 5/1990 | Tse et al. |
| 4,943,350 | A | 7/1990 | Bogart et al. |
| 4,950,545 | A | 8/1990 | Walter et al. |
| 5,008,131 | A | 4/1991 | Bakhshi |
| 5,009,932 | A | 4/1991 | Klett et al. |
| 5,048,589 | A | 9/1991 | Cook et al. |
| 5,059,282 | A | 10/1991 | Ampulski et al. |
| 5,089,296 | A | 2/1992 | Bafford et al. |
| 5,098,522 | A | 3/1992 | Smurkoski et al. |
| 5,098,979 | A | 3/1992 | O'lenick, Jr. |
| 5,145,527 | A | 9/1992 | Clifford et al. |
| 5,164,046 | A | 11/1992 | Ampulski et al. |
| 5,165,261 | A | 11/1992 | Cho |
| 5,178,729 | A | 1/1993 | Janda |
| 5,215,626 | A | 6/1993 | Ampulski et al. |
| 5,215,629 | A | 6/1993 | Skatulla et al. |
| 5,219,620 | A | 6/1993 | Potter et al. |
| 5,227,023 | A | 7/1993 | Pounder et al. |
| 5,227,242 | A | 7/1993 | Walter et al. |
| 5,230,776 | A | 7/1993 | Andersson et al. |
| 5,234,547 | A | 8/1993 | Knight et al. |
| 5,237,035 | A | 8/1993 | O'lenick, Jr. et al. |
| 5,245,545 | A | 9/1993 | Taylor |
| 5,246,545 | A | 9/1993 | Ampulski et al. |
| 5,246,546 | A | 9/1993 | Ampulski |
| 5,260,171 | A | 11/1993 | Smurkoski et al. |
| 5,275,700 | A | 1/1994 | Trokhan |
| 5,277,242 | A | 1/1994 | Arrington |
| 5,328,565 | A | 7/1994 | Rasch et al. |
| 5,328,685 | A | 7/1994 | Janchitraponvej et al. |
| 5,334,289 | A | 8/1994 | Trokhan et al. |
| 5,348,609 | A | 9/1994 | Russell et al. |
| 5,353,521 | A | 10/1994 | Orloff |
| 5,366,161 | A | 11/1994 | Potter et al. |
| 5,385,643 | A | 1/1995 | Ampulski |
| 5,389,204 | A | 2/1995 | Ampulski |
| 5,399,412 | A | 3/1995 | Sudall et al. |
| 5,431,786 | A | 7/1995 | Rasch et al. |
| 5,466,337 | A | 11/1995 | Darlington et al. |
| 5,492,655 | A | 2/1996 | Morton et al. |
| 5,494,554 | A | 2/1996 | Edwards et al. |
| 5,496,624 | A | 3/1996 | Stelljes et al. |
| 5,500,277 | A | 3/1996 | Trokhan et al. |
| 5,503,715 | A | 4/1996 | Trokhan et al. |
| 5,505,997 | A | 4/1996 | Strong et al. |
| 5,510,001 | A | 4/1996 | Hermans et al. |
| 5,514,523 | A | 5/1996 | Trokhan et al. |
| 5,525,345 | A | 6/1996 | Warner et al. |
| 5,529,665 | A | 6/1996 | Kaun |
| 5,538,595 | A | 7/1996 | Trokhan et al. |
| 5,552,020 | A | 9/1996 | Smith et al. |
| 5,554,467 | A | 9/1996 | Trokhan et al. |
| 5,558,873 | A | 9/1996 | Funk et al. |
| 5,566,724 | A | 10/1996 | Trokhan et al. |
| 5,573,637 | A | 11/1996 | Ampulski et al. |
| 5,591,306 | A | 1/1997 | Kaun |
| 5,591,309 | A | 1/1997 | Rugowski et al. |
| 5,598,642 | A | 2/1997 | Orloff et al. |
| 5,598,643 | A | 2/1997 | Chuang et al. |
| 5,601,871 | A | 2/1997 | Krzysik et al. |
| 5,605,719 | A | 2/1997 | Tench et al. |
| 5,607,980 | A | 3/1997 | McAtee et al. |
| 5,614,293 | A | 3/1997 | Krzysik et al. |
| 5,623,043 | A | 4/1997 | Fost et al. |
| 5,624,676 | A | 4/1997 | Mackey et al. |
| 5,624,790 | A | 4/1997 | Trokhan et al. |
| 5,628,876 | A | 5/1997 | Ayers et al. |
| 5,635,191 | A | 6/1997 | Roe et al. |
| 5,635,469 | A | 6/1997 | Fowler et al. |
| 5,637,194 | A | 6/1997 | Ampulski et al. |
| 5,638,876 | A | 6/1997 | Shimotoyodome et al. |
| 5,643,588 | A | 7/1997 | Roe et al. |
| 5,650,218 | A | 7/1997 | Krzysik et al. |

5,656,132 A 8/1997 Farrington et al.
5,665,426 A 9/1997 Krzysik et al.
5,667,636 A 9/1997 Engel et al.
5,679,218 A * 10/1997 Vinson et al. ..... 162/109
5,688,496 A 11/1997 Fost et al.
5,695,607 A * 12/1997 Oriaran et al. ..... 162/112
5,699,626 A 12/1997 Chuang et al.
5,701,682 A 12/1997 Chuang et al.
5,705,164 A 1/1998 Mackey et al.
5,707,434 A 1/1998 Halloran et al.
5,707,435 A 1/1998 Halloran
5,725,736 A 3/1998 Schroeder et al.
5,756,112 A 5/1998 Mackey
5,763,044 A 6/1998 Ahr et al.
5,772,845 A 6/1998 Farrington et al.
5,785,813 A 7/1998 Smith et al.
5,792,737 A 8/1998 Gruning et al.
5,807,956 A 9/1998 Czech
5,814,188 A 9/1998 Vinson et al.
5,830,317 A 11/1998 Vinson et al.
5,830,321 A 11/1998 Lindsay et al.
5,830,483 A 11/1998 Seidel et al.
5,840,403 A 11/1998 Trokhan et al.
5,846,380 A 12/1998 Van Phan et al.
5,849,313 A 12/1998 Fost et al.
5,849,447 A 12/1998 Matsuda
5,855,739 A 1/1999 Ampulski et al.
5,856,544 A 1/1999 Czech et al.
5,857,627 A 1/1999 Horwell et al.
5,861,143 A 1/1999 Peterson et al.
5,869,075 A 2/1999 Krzysik
5,871,763 A 2/1999 Luu et al.
5,882,573 A 3/1999 Kwok et al.
5,885,416 A 3/1999 Marinack et al.
5,885,418 A 3/1999 Anderson et al.
5,885,697 A 3/1999 Krzysik et al.
5,893,965 A 4/1999 Trokhan et al.
5,897,745 A 4/1999 Ampulski et al.
5,902,540 A 5/1999 Kwok
5,904,298 A 5/1999 Kwok et al.
5,904,809 A 5/1999 Rokman et al.
5,925,469 A 7/1999 Gee
5,932,068 A 8/1999 Farrington, Jr. et al.
5,935,381 A 8/1999 Trokhan et al.
5,935,383 A 8/1999 Sun et al.
5,954,921 A 9/1999 Dahmen et al.
5,968,853 A 10/1999 Kelly et al.
5,972,813 A 10/1999 Polat et al.
5,981,044 A * 11/1999 Phan et al. ..... 428/212
5,981,681 A 11/1999 Czech
5,985,434 A 11/1999 Qin et al.
5,990,377 A 11/1999 Chen et al.
6,010,598 A 1/2000 Boutilier et al.
6,017,417 A 1/2000 Wendt et al.
6,027,611 A 2/2000 McFarland et al.
6,030,675 A 2/2000 Schroeder et al.
D421,528 S 3/2000 Shakora
6,033,723 A 3/2000 Kistler et al.
6,054,020 A 4/2000 Goulet et al.
6,077,375 A 6/2000 Kwok
6,080,686 A 6/2000 Floyd
6,090,885 A 7/2000 Kuo et al.
6,096,169 A 8/2000 Hermans et al.
6,103,060 A 8/2000 Munerelle et al.
6,103,063 A 8/2000 Oriaran et al.
6,103,128 A 8/2000 Koso et al.
6,120,784 A 9/2000 Snyder, Jr.
6,126,784 A 10/2000 Ficke et al.
6,132,803 A 10/2000 Kelly et al.
6,136,147 A 10/2000 Edwards et al.
6,143,135 A 11/2000 Hada et al.
6,149,768 A 11/2000 Hepford
6,149,769 A 11/2000 Mohammadi et al.
6,179,961 B1 1/2001 Ficke et al.
6,183,814 B1 2/2001 Nangeroni et al.
6,197,154 B1 3/2001 Chen et al.
6,217,707 B1 4/2001 Garvey et al.
6,217,940 B1 4/2001 Kuni
6,224,714 B1 5/2001 Schroeder et al.
6,231,719 B1 5/2001 Garvey et al.
6,238,518 B1 5/2001 Rokman et al.
6,238,682 B1 5/2001 Klofta et al.
6,261,580 B1 7/2001 Lehrter et al.
6,274,667 B1 8/2001 Shannon et al.
6,287,418 B1 9/2001 Schroeder et al.
6,306,408 B1 10/2001 Eichhorn et al.
6,315,866 B1 11/2001 Sanchez
6,319,365 B1 11/2001 Inoue
6,322,604 B1 11/2001 Midkiff
6,332,952 B1 12/2001 Hsu et al.
6,365,667 B1 4/2002 Shannon et al.
6,379,498 B1 4/2002 Burns et al.
6,395,957 B1 5/2002 Chen et al.
6,423,183 B1 7/2002 Goulet et al.
6,432,268 B1 8/2002 Burghardt
6,432,270 B1 8/2002 Liu et al.
6,458,243 B1 10/2002 Jones et al.
6,488,812 B2 12/2002 Shannon et al.
6,514,383 B1 2/2003 Liu et al.
6,547,928 B2 4/2003 Barnholtz et al.
6,582,560 B2 6/2003 Runge et al.
6,599,394 B1 7/2003 Liu et al.
6,607,783 B1 8/2003 Vander Heiden et al.
6,706,410 B2 3/2004 Horenziak et al.
6,716,309 B2 4/2004 Chuang et al.
2002/0092635 A1 7/2002 Capizzi
2002/0112835 A1 8/2002 Liu et al.
2002/0139500 A1 10/2002 Runge et al.
2002/0162243 A1 11/2002 Rungee et al.
2003/0022568 A1 1/2003 Branham et al.
2003/0032352 A1 2/2003 Chang et al.
2003/0056916 A1 3/2003 Horenziak et al.
2003/0056917 A1 3/2003 Jimenez
2003/0077314 A1 4/2003 Shannon et al.
2003/0118848 A1 6/2003 Liu
2003/0159786 A1 8/2003 Runge et al.
2003/0188839 A1 10/2003 Urscheler
2003/0188841 A1 10/2003 Buder et al.
2003/0221808 A1 12/2003 Capizzi
2004/0074622 A1 4/2004 Liu et al.
2004/0084164 A1 5/2004 Shannon et al.
2004/0086726 A1 5/2004 Moline et al.
2004/0086727 A1 5/2004 Flugge et al.
2004/0118532 A1 6/2004 Sarbo et al.
2004/0118533 A1 6/2004 Shannon et al.
2004/0144507 A1 7/2004 Shannon et al.

FOREIGN PATENT DOCUMENTS

EP 0 195 458 A1 9/1986
EP 0 098 362 B1 4/1989
EP 0 333 212 A2 9/1989
EP 0 336 439 A2 10/1989
EP 0 347 153 A2 12/1989
EP 0 347 154 A2 12/1989
EP 0 350 277 A 1/1990
EP 0 497 100 A2 8/1992
EP 0 347 177 B2 5/1995
EP 0 347 154 B1 1/1996
EP 0 643 083 B1 5/1997
EP 0 347 176 B2 7/1997
EP 1 013 823 A1 6/2000
EP 1 023 863 A1 8/2000

| | | | |
|---|---|---|---|
| EP | 0 708 860 | B1 | 11/2000 |
| EP | 1 059 032 | A1 | 12/2000 |
| EP | 1 149 947 | A2 | 10/2001 |
| EP | 1 236 827 | A1 | 9/2002 |
| FR | 2715052 | A1 | 7/1999 |
| GB | 1372787 | | 11/1974 |
| WO | WO 97/04171 | A1 | 2/1997 |
| WO | WO 98/40425 | | 9/1998 |
| WO | WO 99/05358 | | 2/1999 |
| WO | WO 99/13158 | A1 | 3/1999 |
| WO | WO 99/19081 | A1 | 4/1999 |
| WO | WO 99/34057 | A1 | 7/1999 |
| WO | WO 99/55962 | | 11/1999 |
| WO | WO 00/04233 | | 1/2000 |
| WO | WO 00/15907 | A1 | 3/2000 |
| WO | WO 00/71177 | A1 | 11/2000 |
| WO | WO 00/77303 | | 12/2000 |
| WO | WO 01/04416 | A1 | 1/2001 |
| WO | WO 01/14631 | | 3/2001 |
| WO | WO 01/28337 | A2 | 4/2001 |
| WO | WO 01/29312 | | 4/2001 |
| WO | WO 01/29315 | A1 | 4/2001 |
| WO | WO 01/49937 | A1 | 7/2001 |
| WO | WO 02/44470 | A1 | 6/2002 |
| WO | WO 02/48457 | A | 6/2002 |
| WO | WO 02/072951 | A2 | 9/2002 |
| WO | WO 03/021037 | A1 | 3/2003 |
| WO | WO 03/037394 | A1 | 5/2003 |

OTHER PUBLICATIONS

Yan, Zegui et al., Synthesis and Characterization of Cationic Copolymers of Butylacrylate and [3–(Methacryloylamino)–propyl]trimethylammonium Chloride, *Journal of Polymer Science, Part A: Polymer Chemistry*, vol. 39, 2001, pp. 1031–1039.

TAPPI Official Test Method T 530 pm–89, "Size Test for Paper By Ink Resistance (Hercules Method)," published by the TAPPI Press, Atlanta, Georgia, revised 1989, pp. 1–5.

"Recent Developments in Foam Application Systems," Gaston County Environmental Systems, Gaston Systems brochure, 4 pages.

Camp Jr., J.G., "Recent Developments in Foam Application Systems," *Journal of Coated Fabrics*, vol. 19, Apr. 1990, pp. 252–260.

Patent Abstract of JP 3–266367 B Description of Dow Corning Toray Silicone Co. Ltd., "Silicone Emulsion Composition for Treatment of Wiping Paper."

Foulger, M. et al., "New Technology to Apply Starch and Other Additivies," *Pulp & Paper Canada*, vol. 100, No. 2, 1999, pp. 24–25.

TAPPI Official Test Method T 402 om–93, "Standard Conditioning and Testing Atmospheres For Paper, Board, Pulp Handsheets, and Related Products," published by the TAPPI Press, Atlanta, Georgia, revised 1993, pp 1–3.

TAPPI Official Method T 411 om–89, "Thickness (Caliper) of Paper, Paperboard, and Combined Board," published by the TAPPI Press, Atlanta, Georgia, revised 1989, pp. 1–3.

* cited by examiner

SOFT TISSUE PRODUCTS CONTAINING SELECTIVELY TREATED FIBERS

BACKGROUND OF THE INVENTION

In the manufacture of tissue products, such as facial tissue, bath tissue, paper towels, dinner napkins and the like, a wide variety of product properties are imparted to the final product through the use of chemical additives. One common attribute imparted to tissue sheets through the use of chemical additives is softness. There are two types of softness that are typically imparted to tissue sheets through the use of chemical additives. The two types are bulk softness and topical or surface softness.

Bulk softness may be achieved by a chemical debonding agent. Such debonding agents are typically quaternary ammonium entities containing long chain alkyl groups. The cationic quaternary ammonium entity allows for the agent to be retained on the cellulose via ionic bonding to anionic groups on the cellulose fibers. The long chain alkyl groups provide softness to the tissue sheet by disrupting fiber-to-fiber hydrogen bonds within the tissue sheet.

Such disruption of fiber-to-fiber bonds provides a two-fold purpose in increasing the softness of the tissue sheet. First, the reduction in hydrogen bonding produces a reduction in tensile strength thereby reducing the stiffness of the tissue sheet. Secondly, the debonded fibers provide a surface nap to the tissue sheet enhancing the "fuzziness" of the tissue sheet. This tissue sheet fuzziness may also be created through use of creping as well, where sufficient interfiber bonds are broken at the outer tissue surface to provide a plethora of free fiber ends on the tissue surface.

Most bulk softener and debonder agents are added in the wet end of the tissue making process. The agents are typically added prior to the formation of the tissue sheet while the pulp fibers are in a slurry of water, typically at a consistency of about 5% or less. A specific limitation of wet end chemical additive addition may be a need for the chemical additives to possess a charge, cationic, anionic or amphiphilic. The cationic charge of the chemical additive is attracted to the anionic charge of the pulp fibers, allowing for the chemical additives to be retained on the pulp fibers. Where anionic chemical additives are used, a cationic promoter may be required to retain the chemical additives on the pulp fibers. A host of additional chemical additives may also be added in the wet end of the tissue making process to help modify the tissue product properties including, but not limited to, wet strength agents, dry strength agents, sizing agents, opacifiers, and the like.

A multi-layered tissue structure may be utilized to enhance the softness of the tissue sheet. In one embodiment of the present invention, a thin layer of strong softwood kraft pulp fibers is used in the inner layer to provide the necessary tensile strength for the tissue product. The outer layers of such structures may be composed of shorter hardwood kraft pulp fibers while the inner layer or layers may be composed of longer softwood kraft pulp fibers. The hardwood kraft pulp fibers may be treated with a debonding agent and the softwood kraft pulp fibers may be treated with a strength agent. Such chemical additive additions may be accomplished in the wet end of the tissue making process by adding the chemical additives to the individual pulp fiber slurries. This may be accomplished as well with blended pulp fiber furnishes as described in U.S. Pat. No. 5,785,813, issued on Jul. 28, 1998 to Smith et al.

One limitation associated with wet end chemical additive addition is the limited availability of adequate bonding sites on the pulp fibers to which the chemical additives may attach themselves. Under such circumstances, the various molecules of the wet end chemical additive or additives compete for the limited available bonding sites, resulting in incomplete retention of the chemical additives on the pulp fibers. The unretained chemical additive or additives, being water soluble or dispersible, are free to attach itself to other pulp fibers within the tissue sheet as the water is drained from the tissue sheet. The unretained chemical additive may also be removed with the process water during dewatering. As the process water is recycled in the tissue making process, the concentration of the chemical additives may build up in the system and again are free to attach itself to other pulp fibers within the tissue sheet.

Hence, in the case of both multi-layered and blended tissue sheets, despite the treatment of individual pulp fiber species, chemical contamination by chemical additives from treatments of other pulp fiber species may occur. Thus, despite attempts to keep the chemical additives from contaminating other pulp fibers, such as debonder agents, using the example from above, becoming attached to softwood kraft pulp fibers and strength agents becoming attached to hardwood kraft pulp fibers may occur, resulting in an overall detriment to tissue product quality and low chemical additive performance. At other times, certain chemical additives may not be compatible with other chemical additives being used in the tissue making process. Such incompatible interactions may be detrimental to the efficiency of the tissue making process, causing issues such as felt and fabric filling, deposit formation either in the tissue sheet or on process equipment, or effect the downstream efficiency of such things as creping adhesives.

U.S. Pat. No. 6,423,183, issued on Jul. 23, 2002 to Goulet et al. discloses a process to reduce levels of unadsorbed chemical additives in the tissue making process water by treating a pulp fiber slurry with an adsorbable, water soluble or water dispersible chemical additive, dewatering the pulp fiber slurry to a consistency of about 20 to about 30 percent to remove the unretained adsorbable chemical additive, redispersing the dewatered pulp fiber slurry at a consistency of about 3 to about 5 percent, further diluting the pulp fiber slurry, forwarding to a stratified headbox and forming a layered tissue product using conventional tissue making processes. Process water contamination is reduced by insuring that the filtrate containing the unretained chemical additive is not brought forward in the tissue making process. The effects of unretained chemical additives are reduced, but unretained chemical additives may be still present in the process water that is forwarded with the dewatered pulp fiber slurry.

Many methods require that a chemical additive be substantive to the pulp fibers as the chemical additive is applied to the pulp fibers while the pulp fibers are in a dilute slurry with water. As such, one skilled in the art would not be expect the tissue making process of the present invention to work with hydrophobic, low water solubility chemical additives such as polysiloxanes, mineral oils, and the like. While such hydrophobic, low water solubility chemical additives may be made into water dispersible emulsions using surfactants, generally these chemical additives may have poor adsorption onto pulp fibers and unless the resulting emulsion is evaporated to dryness to separate the emulsified hydrophobic chemical additive from the emulsifying particle, the emulsified hydrophobic chemical additive may be easily stripped from the pulp fibers when the pulp fibers are reslurried in the tissue making process. Even if the process disclosed in U.S. Pat. No. 6,423,183, discussed above, chemical additive systems employing poorly substantive chemical additives may show cross contamination of the chemical additives across the various pulp fiber species in the tissue sheet as well as unacceptably poor retention of the chemical additives.

The topical or surface softness of a tissue sheet, and ultimately the resulting tissue product, may be achieved by topically applying a softener agent to the surface of the tissue sheet and/or tissue product. Typically, topical softener agents are generally non-ionic and hydrophobic. One effective softener agent may be polysiloxane. Polysiloxane treated tissue sheets are described in U.S. Pat. No. 4,950,545, issued on Aug. 21, 1990 to Walter et al.; U.S. Pat. No. 5,227,242, issued on Jul. 13, 1993 to Walter et al.; U.S. Pat. No. 5,558,873, issued on Sep. 24, 1996 to Funk et al.; U.S. Pat. No. 6,054,020, issued on Apr. 25, 2000 to Goulet et al.; U.S. Pat. No. 6,231,719, issued on May 15, 2001 to Garvey et al.; and, U.S. Pat. No. 6,432,270, issued on Aug. 13, 2002 to Liu et al., which are incorporated by reference to the extent that they are non-contradictory herewith. A variety of substituted and non-substituted polysiloxanes may be used.

While polysiloxanes may provide improved softness in a tissue sheet, there may be some drawbacks to their use. First, polysiloxanes may be relatively expensive. Only polysiloxane on the outermost surface of the tissue sheet may contribute to topical or surface softness of the tissue sheet. Polysiloxanes may be effective debonding agents. However, when present in the z-direction of the tissue sheet, the polysiloxanes may negatively impact the strength of the tissue sheet while contributing to the bulk softness of the tissue sheet from debonding. Polysiloxanes and other hydrophobic chemistries tend to be poorly retained in the wet end of the tissue making process, and therefore may require topical application to a formed tissue sheet. This topical application usually involves applying the chemical additive as an emulsion to the tissue sheet using spray or printing applications. As tissue sheets are relatively thin and non-dense, topical printing and spraying may cause significant penetration of the chemical additive in the z-direction, and hence, contamination of the various pulp fiber species with the topically applied chemical additive even in a layered tissue sheet.

Therefore, there is an interest for preparing tissue products containing hydrophobic chemical additives, such as polysiloxane, wherein the hydrophobic chemical additive is selectively applied to only certain pulp fibers within the tissue sheet. There is an interest for the incorporation of hydrophobic chemical additives in the wet end of the tissue making process, avoiding the need for additional application equipment after the tissue machine and whereby the hydrophobic chemical additive is substantially located on specific pulp fiber species. There is an interest in minimizing cross contamination of pulp fibers not treated with the hydrophobic chemical additives so as to improve the performance of the hydrophobic chemical additive in the tissue sheet. For example, if polysiloxane is used, minimizing the z-directional penetration of the polysiloxane within the tissue sheet may provide more polysiloxane on the surface of the tissue sheet and better topical or surface softness of the tissue sheet is achieved at lower levels of polysiloxane. By avoiding cross contamination of strength layers within the tissue sheet, the polysiloxane does not contribute to significant strength loss within the tissue sheet, providing softer tissue sheets, and ultimately, tissue products comprising higher strength levels.

SUMMARY OF THE INVENTION

It has now been discovered that hydrophobic chemical additives, typically not substantive to pulp fibers when applied in the wet end of the tissue making process, may be retained in the wet end of the tissue making process by first treating dried or substantially dried pulp fibers with the hydrophobic chemical additives. Such an addition may be accomplished at the pulp mill during production of the dry lap pulp. Furthermore, it has been discovered that once the pulp fibers are dried to about 80% or higher consistency, the hydrophobic chemical additives of the present invention may be adsorbed in such a manner that the hydrophobic chemical additives have little tendency to be desorbed from the pulp fibers in the wet end of the tissue making process. Furthermore, when the hydrophobic chemical additives of the present invention are desorbed in the wet end of the tissue making process, the hydrophobic chemical additives have little tendency to be re-adsorbed by the wet pulp fibers. Hence, tissue products containing pulp fibers selectively treated with the hydrophobic chemical additives may be produced. Furthermore, it has been discovered that tissue products comprising selectively treated pulp fibers have unique properties not achievable with traditional application technologies.

In accordance with one embodiment of the present invention, a tissue sheet, such as a soft tissue sheet or towel sheet, comprises pulp fibers selectively treated with a hydrophobic chemical additive. The term "selectively treated" as used herein, means that the hydrophobic chemical additive is homogenously distributed on specific pulp fibers. In one embodiment of the present invention, the distribution of the pulp fibers is based on pulp fiber length. That is, the hydrophobic chemical additive may be located on a certain pulp fiber size range, whereas pulp fibers outside this size range comprise little or none of the hydrophobic chemical additive. In one embodiment, the hydrophobic chemical additive may be located primarily on the short pulp fiber (typically hardwood kraft pulp fibers). In another embodiment, the hydrophobic chemical additive may be located on the longer pulp fibers (typically softwood kraft pulp fibers). If the hydrophobic chemical additive is to provide a softening function, in one embodiment, the hydrophobic chemical additive may be selectively located on the hardwood kraft pulp fibers.

In co-pending U.S. patent application Ser. No. 09/802,529 filed on Apr. 3, 2001 under the name Runge et al., a method for preparing fibers containing hydrophobic entities, including hydrophobic polysiloxanes, at a pulp mill is disclosed. These so called "polysiloxane pretreated pulp fibers" may then be re-dispersed in the wet end of a paper-making process to manufacture tissue sheets or the resulting tissue products containing polysiloxane. It has been found that pulp fibers pretreated with polysiloxane and dried prior to being re-dispersed and formed into a tissue sheet may demonstrate excellent retention of the polysiloxane through the tissue making process. In the present invention, it has also been found that any hydrophobic chemical additive which may be desorbed from the selectively treated pulp fibers during the tissue making process may have little or no tendency to be adsorbed by selectively non-treated pulp fibers during the tissue making process.

While the tissue sheets of the present invention may be applicable to any tissue sheet, particular interest may be in tissue and towel products. It is understood that the term "tissue sheet" as used herein refers to tissue and towel sheets. The term "tissue product" as used herein refers to tissue and towel products. Tissue and towel products as used herein are differentiated from other paper products in terms of their bulk. The bulk of the tissue and towel products of the present invention is calculated as the quotient of the caliper (hereinafter defined), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue and towel products which tend to have much higher calipers for a given basis weight. The tissue and towel products of the present invention may have a bulk of about 2 $cm^3/g$ or greater, more specifically about 2.5 $cm^3/g$ or greater, and still more specifically about 3 $cm^3/g$ or greater.

The tissue sheet and/or tissue products of the present invention may comprise layered or blended tissue sheets or a combination of layered and blended tissue sheets. The term "blended tissue sheet" as used herein refers to the process of blending various pulp fiber types prior to formation of the tissue sheet. In accordance with some embodiments of the present invention, selectively treated fibers may be blended with selectively non-treated fibers prior to formation of the tissue sheet. The tissue sheet may have a heterogeneous distribution of the various pulp fibers in the z-direction within the ply (tissue sheet).

The term "average fiber length," refers to the length weighted average fiber length as determined with a fiber length analysis instrument. An instruments suitable for such a measurement is a Kajaani Model FS-200 fiber analyzer available from Kajaani Electronics located at Norcross, Ga. or with the Optest FQA LDA36 instrument available from Optest Instruments, Inc. located at Hawkesbury, Ontario.

The term "layered tissue sheet" as used herein refers to the formation of a stratified tissue sheet, wherein a particular tissue sheet or tissue sheets making up a multi-ply tissue product contain a z-directional pulp fiber gradient. In one method of the formation of a layered tissue sheet, individual slurries of pulp fibers are sent to a divided headbox and applied to a moving belt where the pulp fibers are dewatered by any of a variety of processes and further dried to form a tissue sheet that has a specific distribution of pulp fibers in the z-direction based on the split of the individual furnishes. Two or more layers may be present in a given tissue sheet of a multi-ply tissue product. One embodiment of the present invention may employ a three-layer structure.

The term "selectively non-treated pulp fibers" as used herein refers to pulp fibers that have not been treated with a hydrophobic chemical additive of the present invention. It is understood that the pulp fibers may be treated with other chemical additives used in tissue making processes. Where it states that a tissue sheet or a layer of a tissue sheet is comprised of or otherwise contains selectively non-treated pulp fibers or is free of or otherwise does not contain hydrophobic chemical additive selectively treated pulp fibers, it is understood that about 30 or less percent of the total amount of the selectively treated pulp fibers in the tissue sheet is present in the given tissue sheet or layer of the tissue sheet being described unless specifically disclosed otherwise. Where it states that a tissue sheet or a layer of a tissue sheet is comprised of or otherwise contains selectively treated pulp fibers, it is understood that about 70 percent or greater of the total amount of the selectively treated pulp fibers in the tissue sheet is present in the given tissue sheet or layer of the tissue sheet being described unless specifically disclosed otherwise.

It has been found that if a hydrophobic chemical additive, for example a polysiloxane, penetrates the tissue sheet to too great of a depth that the hydrophobicity of the tissue sheet is increased greatly. Hydrophobicity may be an undesirable characteristic of an absorbent tissue sheet or certain applications of a soft tissue sheet. One example is where the hydrophobic chemical additive is able to migrate to other pulp fibers within the tissue sheet the hydrophobicity of the tissue sheet will be increased. In one embodiment of the present invention, the selectively treated pulp fibers may be concentrated towards the outer surfaces and/or the outer layers the tissue sheet, thereby mitigating hydrophobicity limitations caused by migration of the hydrophobic chemical additive. Such tissue sheets possess a high z-directional gradient of the hydrophobic chemical additive that allows for softer tissue products made from such tissue sheets to be obtained at lower levels of hydrophobic chemical additive. Thus, soft, economical, absorbent tissue sheets comprising pulp fibers selectively treated with hydrophobic chemical additives may be prepared.

The selectively treated fibers may be used to enhance the absorbency of a tissue product relative to a tissue product containing the hydrophobic chemical additive but wherein the location of the hydrophobic chemical additive is not constrained to selectively treated pulp fibers. For example, in one embodiment of the present invention, the hydrophobic chemical additive may be a polysiloxane. To obtain acceptable absorbent characteristics within the tissue sheet comprising the polysiloxane selectively treated pulp fibers, it may be beneficial to have the layer or layers of the tissue sheet comprising the selectively treated pulp fiber be adjacent to a layer within the tissue sheet comprising selectively non-treated pulp fibers. Contamination of the adjacent layer with the polysiloxane would significantly increase the hydrophobicity of the tissue sheet. It is also found that the polysiloxane should not penetrate the tissue sheet in z-direction beyond a predetermined depth. Penetration of the hydrophobic chemical additive within the z-direction of the tissue sheet beyond the predetermined depth would again increase the hydrophobicity of the tissue sheet. Penetration of the polysiloxane in the z-direction of the tissue sheet may be controlled with selectively treated pulp fibers by controlling the depth of the layer comprising the selectively treated pulp fibers relative to the depth of the ply comprising the selectively treated pulp fibers.

The depth of one layer of a tissue sheet (ply) relative to the total depth of the tissue sheet (ply) is determined from the weight ratio of that layer relative to the total weight of the tissue sheet (ply), often referred to as the pulp fiber split. For example, a three layered tissue sheet (ply) having a pulp fiber split of about 30/40/30 NHWK/NSWK/NHWK will have a construction wherein about 30% by weight of the total tissue sheet (ply) weight consists of northern hardwood kraft (NHWK) pulp fibers located in one of the outer layers of the tissue sheet (ply), about 40% by weight of the total tissue sheet (ply) weight consists of northern softwood kraft (NSWK) pulp fibers located in the inner layer, and about 30% by weight of the total tissue sheet (ply) weight consists of northern hardwood kraft pulp fibers located in the other outer layer of the tissue sheet (ply).

The absorbency of the tissue sheet is determined by the Wet Out Time. As used herein, the term "Wet Out Time" is related to absorbency and is the time it takes for a given sample of a tissue sheet to completely wet out when placed in water. In specific embodiments of the present invention the Wet Out Time (hereinafter defined) about 300 seconds or less. In other specific embodiments the wet out time is about 150 seconds or less, more specifically about 120 seconds or less, and still more specifically about 90 seconds or less.

In one embodiment of the present invention, the hydrophobic chemical additive that may be used to selectively treat the pulp fibers is polysiloxane. The particular structure of the polysiloxanes of the present invention may provide the desired tissue sheet and/or tissue product properties while having little tendency to be desorbed from the selectively treated pulp fibers and be readsorbed by selectively non-treated pulp fibers in the tissue sheet. The polysiloxanes are characterized in having a backbone structure:

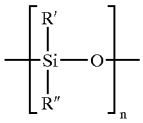

wherein R' and R" may be a broad range of organo and non-organo groups including mixtures of such groups and where n is an integer ≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers. The scope of the present invention should not be construed as limited by a particular polysiloxane structure so long as that polysiloxane structure delivers the aforementioned product benefits to the tissue sheet and/or the final tissue product.

While not wishing to be bound by theory, the softness benefits that polysiloxanes deliver to pulp fibers selectively treated with the polysiloxanes of the present invention may be, in part, related to the molecular weight of the polysiloxane. Viscosity is often used as an indication of molecular weight of the polysiloxane as exact number or weight average molecular weights may be difficult to determine. The viscosity of the polysiloxanes of the present invention may be about 25 centipoise or greater, more specifically about 50 centipoise or greater, and most specifically about 100 centipoise or greater. The term "viscosity" as referred to herein refers to the viscosity of the neat polysiloxane itself and not to the viscosity of an emulsion if so delivered. It should also be understood that the polysiloxanes of the present invention may be delivered as solutions containing diluents. Such diluents may lower the viscosity of the polysiloxane solution below the limitations set above, however, the efficacious part of the polysiloxane should conform to the viscosity ranges given above. Examples of such diluents include but is not limited to oligomeric and cyclo-oligomeric polysiloxanes such as octamethylcyclotetrasiloxane, octamethyltrisiloxane, decamethylcyclopentasiloxane, decamethyltetrasiloxane and the like, including mixtures of these diluents.

In another embodiment of the present invention, the selectively treated pulp fibers are utilized in a multi-layer tissue sheet in a manner such that there is a z-directional gradient of the hydrophobic chemical additive within the tissue sheet. The z-directional gradient of the hydrophobic chemical additive may be such that the highest concentration of the hydrophobic chemical additive is located in an inner layer or in the center of the layered tissue sheet, or alternatively, at one or both outer surfaces of the layered tissue sheet.

The z-directional polysiloxane gradient may be determined via X-ray photoelectron spectroscopy (XPS) as described hereinafter. Surface polysiloxane levels are reported as atomic concentration of the Si as determined by the spectrometer. The atomic Si concentration is measured to a depth of around 100 nanometers and is indicative of the polysiloxane content at the surface of the tissue sheet specimen(s). Z-directional polysiloxane gradient is defined as the percent difference in atomic Si concentration between the high polysiloxane content side and the low polysiloxane content side of a tissue sheet. The z-directional polysiloxane gradient is defined via the following equation:

$$\%\ z\text{-directional polysiloxane gradient}=(X-Y)/X*100$$

wherein X is the atomic % Si on the high content side and Y is the atomic % Si on the low content side of the layer comprising the polysiloxane selectively treated pulp fibers and/or pulp fibers treated with polysiloxane. (In the alternative, wherein X is the atomic % Si on the high content side of the tissue sheet treated with polysiloxane and Y is the atomic % Si on the low content side of the tissue sheet treated with polysiloxane.) The higher the % of the z-directional polysiloxane gradient the more soft a tissue sheet may be at a given total polysiloxane content. Where the hydrophobic chemical additive is not a polysiloxane, X will be the concentration of the hydrophobic chemical additive on the high content side and Y will be the concentration of the hydrophobic chemical additive on the low content side.

According to one embodiment, the present invention is a soft, single or multi-ply tissue product. Each ply of the tissue product comprises a first side and an opposing second side. One or more of the plies of the tissue product may comprise a hydrophobic chemical additive wherein the hydrophobic chemical additive is distributed non-uniformly in the z-direction within the ply. That is, the difference between the level of the hydrophobic chemical additive on the first side and the level of the hydrophobic chemical additive on the opposing second side is measured. The % z directional gradient of the hydrophobic chemical additive as defined previously between the first and second sides of the ply of the tissue product may be about 20% or greater, more specifically about 25% or greater, still more specifically about 30% or greater, and most specifically about 35% or greater.

For example, in one embodiment of the present invention, one or more of the plies of the tissue product may comprise a polysiloxane wherein the polysiloxane is distributed non-uniformly in the z-direction within the ply. That is, the level of polysiloxane on the first side as measured in terms of atomic % Si is different from the atomic % Si measured on the opposing second side. The difference in the atomic % Si on the opposing first and second sides of the ply may be about 3 atomic % or greater, more specifically about 4 atomic % or greater, and most specifically about 5 atomic % or greater. The % z directional polysiloxane gradient as defined previously between the first and second sides of the ply may be about 20% or greater, more specifically about 25% or greater, still more specifically about 30% or greater, and most specifically about 35% or greater.

In a multi-ply tissue product, the overall orientation of the plies relative to one another may be varied. However, as polysiloxane treatments are typically applied to improve topical or surface softness of a ply or finished tissue product, one embodiment of a multi-ply tissue product of the present invention may have at least one outer surface being the first or second sides of one of the plies comprising the polysiloxane, thereby placing at least one ply comprising a high or the highest level of polysiloxane outwardly facing so as to be on the one of the outer surfaces of the tissue product contacting the user's skin. In other embodiments of the present invention wherein the multi-ply tissue products comprising more than two plies, polysiloxane may be present in one or more of the plies. In some of these embodiments, the z-directional polysiloxane gradient may be present in at least one of the plies. It may be desirable to have the z-directional polysiloxane gradient in more than one of the plies. In one embodiment of the present invention, the structure of the tissue product comprises at least two plies, wherein the plies having the highest levels of the polysiloxane form the outer surfaces of the tissue product. In one embodiment of the present invention, the inner plies comprise little or no polysiloxane.

In one embodiment of the present invention, the layered tissue sheet (ply) may comprise hardwood and softwood kraft pulp fibers. In other embodiments of the present invention at least one layered tissue sheet (ply) may comprise hardwood and softwood kraft pulp fibers. In some embodiments of the present invention, the hydrophobic chemical additive may be treated on the hardwood kraft pulp fibers with the hydrophobic chemical additive (selectively treated pulp fibers). In other embodiments of the present invention, selectively treated pulp fibers may be applied to at least one of the outer surfaces of the layered tissue sheet (ply). In variations of this embodiment of the present invention, additional layers of the layered tissue sheet (ply) may or may not comprise selectively treated pulp fibers, the order of the layers of the tissue sheet (ply) and/or the order of tissue sheets (plies) within the tissue product may be varied in any order. Any number of additional layers of a tissue sheet (ply) and/or tissue sheets (plies) may be employed in the tissue product of the present invention.

In one embodiment of the present invention, a single ply tissue product may comprise a three-layer tissue sheet (ply). At least one outer layer of the layered tissue sheet (ply) comprises selectively treated pulp fibers. The selectively treated pulp fibers may comprise hardwood kraft pulp fibers. The outer layers of the layered tissue sheet (ply) form the outer surfaces of the single ply tissue product. In a variation of this embodiment, the inner layer of the layered tissue sheet (ply) may comprise softwood pulp fiber and/or may comprise selectively non-treated pulp fibers. In another variation of this embodiment, the opposing outer layer of the layered tissue sheet (ply) may comprise selectively non-treated pulp fiber. In another embodiment of the present invention, the layered tissue sheet (ply) may be a three layer tissue sheet (ply). One outer layer of the layered tissue sheet (ply) may comprise selectively treated pulp fibers. The inner layer of the layered tissue sheet (ply) may comprise selectively treated pulp fibers which may or may not be hardwood kraft pulp fibers. Alternatively, the inner layer of the layered tissue sheet (ply) may comprise selectively non-treated pulp fibers which may or may not be hardwood kraft pulp fibers. The opposing outer layer of the layered tissue sheet (ply) may comprise selectively non-treated pulp fibers which may or may not be softwood kraft pulp fibers.

In another embodiment of the present invention, a soft, absorbent, single or multi-ply layered tissue product may have one or more of the tissue sheets (plies) of the tissue product may comprise pulp fibers selectively treated with a hydrophobic chemical additive wherein the layers of the tissue sheet (ply) or plies containing the selectively treated pulp fibers are adjacent to at least one layer comprising selectively non-treated pulp fibers. In one embodiment, the tissue product is a multi-ply tissue product wherein only the outside layer of one or preferably both the exterior tissue sheets (plies) comprise selectively treated pulp fibers. The structure of the tissue product may be arranged such that there is a gradient of the hydrophobic chemical additive in the z-direction of the tissue sheet (ply) in going from the outer surface of the outer tissue sheet (ply) or tissue sheets (plies) to the inner surface of the outer tissue sheet (ply) or tissue sheets (plies).

In another embodiment of the present invention, the single ply tissue product may comprise a three-layer tissue sheet (ply) wherein the outer layers comprise selectively treated pulp fibers and the inner layer comprises selectively non-treated pulp fibers. The structure of the layered tissue sheet (ply) may be arranged such that there is a z-directional gradient of the hydrophobic chemical additive of the layered tissue sheet (ply) measured from one outer layer, and/or the outer surface formed by the outer layer, to the other outer layer, and/or outer surface formed by the other outer layer, wherein the hydrophobic chemical additive content decreases at the center of the layered tissue sheet (ply) and increases at or adjacent the outer surfaces of the layered tissue sheet (ply). In some embodiments of the present invention, at least one of the inner layers of a layered tissue sheet (ply) comprising at least three layers may have a hydrophobic chemical additive content of about 0%.

One embodiment of the present invention is a method for making a soft, economical, absorbent layered tissue sheet comprising selectively treated pulp fibers, pulp fibers treated with at least one hydrophobic chemical additive. The method comprises: (a) forming a first aqueous suspension of pulp fibers comprising pulp fibers selectively treated with at least one hydrophobic chemical additive; (b) forming at least a second aqueous suspension of pulp fibers wherein the second aqueous suspension of pulp fibers comprised of selectively non-treated pulp fibers; (c) forwarding the first aqueous suspension of pulp fibers to a stratified headbox; (d) forwarding the second aqueous suspension of pulp fibers comprising selectively non-treated pulp fibers to the stratified headbox; (e) depositing the first and second aqueous suspensions of pulp fibers onto a forming fabric to form a wet layered tissue sheet; (f) dewatering the wet layered tissue sheet to form a dewatered layered tissue sheet; and, (g) optionally drying the dewatered layered tissue sheet to form a dried layered tissue sheet. The selectively treated pulp fibers within the layered tissue sheet comprise about 95% or less of the total weight of the tissue sheet, more specifically about 90% or less of the total weight of the tissue sheet, and most specifically about 85% or less of the total weight of the tissue sheet. Optionally, the tissue sheet may have a % z-directional gradient of the hydrophobic chemical additive of about 20% or greater, more specifically about 25% or greater, and still more specifically about 30% or greater. The first aqueous suspension of pulp fibers may further comprise selectively non-treated pulp fibers. The first and second aqueous suspensions of pulp fibers may be deposited onto the forming fabric such that a layer of the selectively treated pulp fibers of the first aqueous suspension of pulp fibers is adjacent to a layer of the selectively non-treated pulp fibers of the second aqueous suspension of pulp fibers. It is understood that the tissue sheet may be converted into a tissue product or may become at least one ply of a multi-ply tissue product.

In another embodiment of the present invention is a method for making a soft, economical, absorbent blended tissue sheet comprising selectively treated pulp fibers, pulp fibers treated with at least one hydrophobic chemical additive. The method comprises: (a) forming at least one aqueous suspension of pulp fibers wherein the aqueous suspension of pulp fibers comprises selectively treated pulp fibers treated with a hydrophobic chemical additive and selectively non-treated pulp fibers; (b) forwarding the aqueous suspension of pulp fibers to a headbox; (c) depositing the aqueous suspension of pulp fibers onto a forming fabric to form a wet tissue sheet; (e) dewatering the tissue sheet to form a dewatered tissue sheet; and, (f) optionally drying the dewatered tissue sheet to form a dried tissue sheet. At least a portion of the tissue sheet of this embodiment is comprised of a blend of selectively treated pulp fibers and selectively non-treated pulp fibers. The selectively treated pulp fibers within the tissue sheet comprise about 95% or less of the total weight of the tissue sheet, more specifically about 90% or less of the total weight of the tissue sheet, and most specifically about 85% or less of the total weight of the tissue sheet. Optionally, the tissue sheet may have a % z-directional gradient of the hydrophobic chemical additive of about 20% or greater, more specifically about 25% or greater, and still more specifically about 30% or greater. It is understood that the tissue sheet may be converted into a tissue product or may become at least one ply of a multi-ply tissue product.

DETAILED DESCRIPTION OF THE INVENTION

Figure 1:
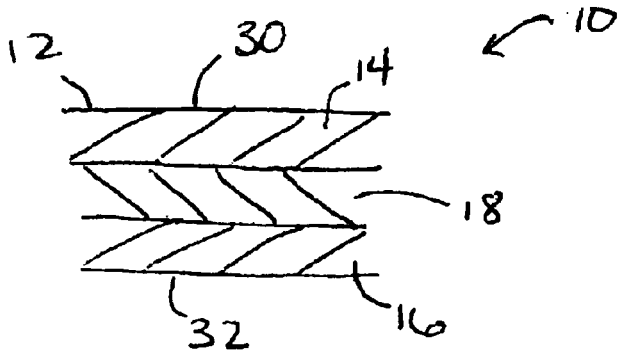
FIG. 1 is a diagram of a tissue sheet of the present invention comprising three layers.

As stated above, the present invention is applicable to any tissue sheet, such sheets include tissue and towel sheet and the resulting tissue and towel products. Tissue products as used herein are differentiated from other tissue products in terms of its bulk. The bulk of the tissue products of the present invention may be calculated as the quotient of the caliper (hereinafter defined), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present invention which tend to have much higher calipers for a given basis weight. The tissue products of the present invention have a bulk of about 2 $cm^3/g$ or greater, more specifically about 2.5 $cm^3/g$ or greater, and still more specifically about 3 $cm^3/g$ or greater.

The basis weight and caliper of the multi-ply tissue products of the present invention may vary widely and may be dependent on, among other things, the number of plies (tissue sheets). Typically the basis weight of a tissue product may range from about 5 $g/m^2$ to about 200 $g/m^2$, still more specifically from about 5 $g/m^2$ to about 140 $g/m^2$, and most specifically from about 5 $g/m^2$ to about 80 $g/m^2$. The caliper of the tissue products of the present invention may be about 2000 microns or less, more specifically about 1500 microns or less, and more specifically about 1000 microns or less.

The location of the selectively treated pulp fibers may be determined by the length of the pulp fibers that are treated by the hydrophobic chemical additive. That is, the tissue sheet and/or tissue products of the present invention may have one distribution of pulp fiber lengths wherein the majority of the hydrophobic chemical additive is applied and one distribution of pulp fiber lengths comprising little or no hydrophobic chemical additive(s). In one embodiment of the present invention, the hydrophobic chemical additive is applied to the long pulp fibers having an average fiber length of about 1.50 mm or greater, more specifically of about 1.75 mm or greater, and most specifically of about 2.00 mm or greater. In another embodiment of the present invention, the hydrophobic chemical additive is located on the short pulp fibers having an average fiber length of about 1.50 mm or less, more specifically of about 1.25 mm or less, and most specifically of about 1.00 mm or less. In other embodiments, the length of the long pulp fibers may be set to a predetermined value and the short pulp fibers may be any length of a predetermined value or shorter than the long pulp fiber predetermined value. To determine location of the hydrophobic chemical additive, the pulp fibers may be fractionated by methods known in the art. The pulp fibers may be collected into specific pulp fiber fractions based on the length of the pulp fibers, such as at least a short pulp fiber fraction and a long pulp fiber fraction. The amount of hydrophobic chemical additive in the short pulp fiber fraction is compared to the amount of hydrophobic chemical additive in the long pulp fiber fraction. The amount of hydrophobic chemical additive is expressed as a weight % of the hydrophobic chemical additive based on total dry weight of the specific pulp fiber fraction being measured. The ratio of the weight % of hydrophobic chemical additive in the fraction comprising the highest amount of hydrophobic chemical additive (typically the pulp fiber fraction comprising the selectively treated pulp fibers) relative to the weight % of hydrophobic chemical additive in the other pulp fiber fraction is about 1.5 or greater, more specifically about 2.0 or greater, and still more specifically about 2.5 or greater.

For multi-layered sheets and/or tissue products, selectively non-treated pulp fibers may be blended with selectively treated pulp fibers in a layer comprising the selectively treated pulp fibers. For example, where the selectively treated pulp fibers are eucalyptus hardwood kraft pulp fibers, the selectively treated eucalyptus hardwood kraft pulp fibers may be blended with selectively non-treated eucalyptus hardwood kraft pulp fibers within a layer of the tissue sheet. The ratio of selectively treated pulp fibers to the selectively non-treated pulp fibers in any layer of a tissue sheet (ply) comprising at least the selectively treated pulp fibers may vary widely and may range from about 5% to about 100% by weight on a dry fiber basis, more specifically from about 10% to about 100% by weight on a dry fiber basis, and still more specifically from about 20% to about 100% by weight on a dry fiber basis. For both blended and layered tissue sheets, the total weight of the selectively treated pulp fibers relative to the total weight of the pulp fibers in the tissue sheet (ply) containing the selectively treated pulp fibers may vary widely from about 0.5% to about 90% on a dry fiber basis, more specifically from about 2% to about 80% on a dry fiber basis, and most specifically from about 5% to about 80% on a dry fiber basis.

Figure 2:
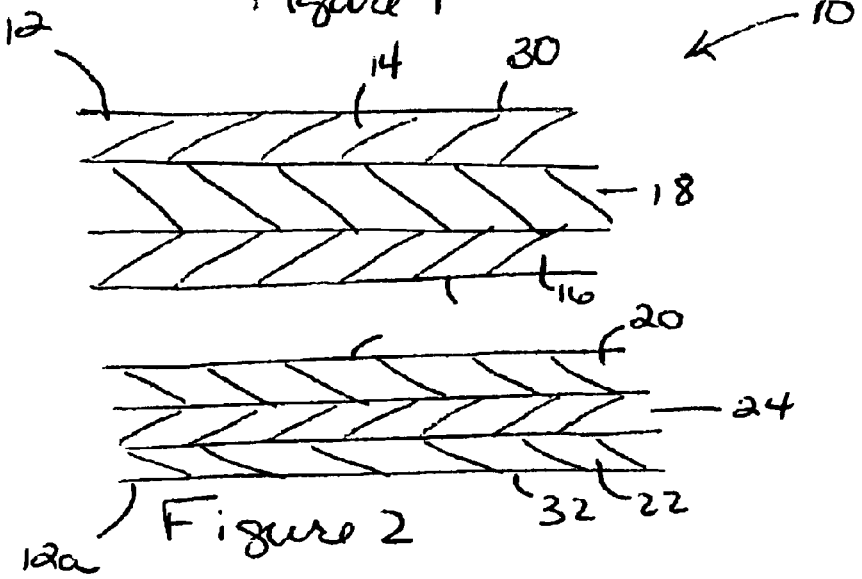
FIG. 2 is a diagram of two tissue sheets of the present invention, each tissue sheet comprising three layers.

One embodiment of the present invention may employ a three-layer structure. FIG. 1 shows a tissue sheet 12 comprising three layers 14, 16, and 18. FIG. 2 shows two tissue sheets 12 and 12*a*, each layer 12 and 12*a* comprises three-layer structure. The layer or layers of the tissue sheets 12 and/or 12*a* may or may not comprise the selectively treated pulp fibers. In the alternative, at least one of the outer surfaces 30 and 32 may comprise the selectively treated pulp fibers. The relative width of the layer or layers comprising the selectively treated pulp fibers may be calculated. The width of the layer comprising the selectively treated pulp fibers may be expressed in terms of weight % of the total of selectively treated pulp fibers and the weight of tissue sheet 12. Single ply or multi-ply tissue products 10, in some embodiments of the present invention, may be made from blended tissue sheets 12 and, in some other embodiments of the present invention, the tissue products 10 may be made from layered tissue sheets 12.

Figure 3:
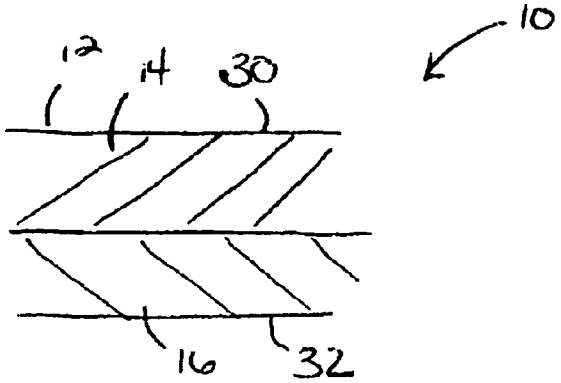
FIG. 3 is a diagram of a tissue sheet of the present invention comprising two layers.

It is understood that a single or multi-ply tissue product 10 may be made from layered tissue sheets 12. Referring to FIG. 1, in a single ply layered tissue product 10, the selectively treated pulp fibers may lie in the first outer layer 14 or the second layer outer 16 or both the first and second outer layers 14 and 16 of the tissue sheet 12 comprising the single ply tissue product 10. In another embodiment of a single ply layered tissue product 10, the selectively treated pulp fibers may reside one the outer surface 30 or the outer surface 32 or on both outer surfaces 30 and 32 of the tissue sheet 12 comprising the single ply tissue product 10. In one embodiment of a single ply tissue product 10, the selectively treated pulp fibers may be positioned in the first and second outer layers 14 and 16 while the inner layer 18 comprises of selectively non-treated pulp fibers. In another embodiment of a single ply tissue product 10, the selectively treated pulp fibers are positioned in one of the first and second outer layers 14 and 16 while the inner layer 18 comprises of selectively non-treated pulp fibers and the other outer layer 16 or 14 comprises selectively non-treated pulp fibers. In another embodiment of the present invention, as shown in FIG. 3, in a two layer single ply tissue product 10, the selectively treated pulp fibers may be positioned in only one of the first and second outer layers 14 or 16 while the other outer layer 16 or 14 would comprise selectively non-treated pulp fibers. In another embodiment, the selectively treated pulp fibers may reside the outer surface 30 of outer layer 14 or on the outer surface 32 of the outer layer 16 or on both outer surfaces 30 and 32 of the outer layers 14 and 16 of the tissue sheet 12, wherein the tissue sheet 12. In such a two layered embodiment, the inner layer 18 is understood not to be present in the two layered single tissue sheet 12.

Referring to FIG. 2, in multi-ply tissue products 10, the selectively treated pulp fibers may be positioned in at least one of the outer first layers 14 and 22 of the tissue sheets 12 and 12*a* which form the outer surfaces 30 and 32, respectively, of a multi-ply tissue product 10. In another embodiment of the present invention, the selectively treated pulp fibers may be positioned in the first outer layers 14 and 22 of the tissue sheets 12 and 12*a*, respectively, which form the outer surfaces 30 and 32 of the multi-ply tissue product 10. It should also be recognized that FIG. 2 represents only the outer tissue sheets 12 and 12*a* of the multi-ply tissue product 10. Any number of additional tissue sheets 12 may be contained between the two outer sheets 12 and 12*a*. Additional tissue sheets 12 may or may not comprise the selectively treated pulp fibers. The tissue sheets 12 comprising selectively non-treated pulp fibers may be layered or non-layered.

In some embodiments of the present invention, it is understood that the discussion of first outer layers 14 and 22 may be applied to the second outer layers 16 and 20 as shown in FIG. 2. Additionally, in some embodiments of the present invention, the discussion of the first outer layers 14 and 22, the second outer layers 16 and 20, and the inner layers 18 and 24 may be applied to additional tissue sheets 12 that may be incorporated into multi-ply tissue products 10.

It is understood that tissue sheet 12 may or may not be the same as tissue sheet 12*a*, but the designation of 12 and 12*a* is provided to more clearly differentiate between the various tissue sheets 12 within the multi-ply tissue products 10 the present invention. It is also understood that the tissue sheets 12 (and tissue sheets 12 and 12*a*) of the present invention may or may not be the same as in that the tissue sheets 12 (or tissue sheets 12 and 12*a*) may comprise different pulp types and/or different percents of pulp types and of the selectively treated pulp fibers to selectively non-treated pulp fibers.

In another embodiment of the present invention, a multi-ply tissue product 10 may have the selectively treated pulp fibers positioned in first outer layers 14 and 22 of the two outer tissue sheets 12 and 12*a* while at least one of the inner layer or layers 16, 18, 20, and 24 of the tissue sheets 12 and 12*a* are comprised of selectively non-treated pulp fibers. In another embodiment of the present invention, a multi-ply tissue product 10 may have the selectively treated pulp fibers positioned in first outer layers 14 and 22 and in the second outer layers 16 and 20 of the two outer tissue sheets 12 and 12*a* while the inner layer or layers 20 and 24 of the tissue sheets 12 and 12*a* may be comprised of selectively non-treated pulp fibers.

In some embodiments of the present invention, it may be desirable in the tissue product 10 to position the outer layer or layers (for example, outer layers 14 and/or 22 as shown in FIG. 2 or outer layers 14 and/or 16 as shown in FIG. 1) comprising selectively treated pulp fibers of the tissue sheets 12 and/or 12*a* such that the outer layer or layers 14 and/or 22 (or alternatively, outer layers 14 and/or 16) comprising the selectively treated pulp fibers are adjacent to an inner layer (for example, inner layers 18 and/or 24 as shown in FIG. 2 or inner layer 18 as shown in FIG. 1) comprising non-treated pulp fibers. In another embodiment of the present invention, one of the first and second outer layers 14 and 16 of the layered single ply tissue product 10 may comprise the selectively treated pulp fibers while the other outer layer 16 or 14 comprising non-treated pulp fibers is adjacent the outer layer 14 or 16 comprising the selectively treated pulp fibers.

In some embodiments of the present invention, as shown in FIGS. 1 and 3, the selectively treated pulp fibers may be positioned in all layers (layers 14, 16, and 18 in FIG. 1 and layers 14 and 16 in FIG. 3). It is also understand that any combination of layers comprising the selectively treated pulp fibers may be utilized in the layers shown in FIGS. 1 and 3 (layers 14, 16, and 18 in FIG. 1 and layers 14 and 16 in FIG. 3). In some embodiments of the present invention, one layer may comprise the selectively treated pulp fibers while at least one of the outer surfaces comprises the selectively treated pulp fibers. Some examples would include, as shown in FIG. 1, at least one of the outer surfaces 30 and/or 32 of a tissue sheet 12 comprises selectively treated pulp fibers while the inner layer 18 of the tissue sheet comprises the selectively treated pulp fibers, or in the alternative, the outer surfaces 30 of layer 14 comprises the selectively treated pulp fibers and the layer 16 comprises the selectively treated pulp fibers. Some examples would include, as shown in FIG. 3, at least one of the outer surfaces 30 and/or 32 of the tissue sheet 12 comprises the selectively treated pulp fibers while at least one of the outer layers 14 and/or 16 comprises the selectively treated pulp fibers.

In a multi-ply tissue product 10, the overall orientation of the tissue sheets 12 relative to one another may be varied. One embodiment of a multi-ply tissue product 10 of the present invention may have at least one outer surface 30 and/or 32 of the layers (for example 14 and/or 22 as shown in FIG. 2 or 14 and/or 16 as shown in FIG. 1) comprising the selectively treated pulp fibers in at least one of the tissue sheets 12, thereby placing at least one layer of the tissue sheets 12 comprising a high or the highest level of hydrophobic chemical additive outwardly facing so as to be on the outer surface 30 and/or 32 contacting the user's skin. In other embodiments of the present invention wherein the multi-ply tissue products 10 comprising more than two tissue sheets 12, the selectively treated pulp fibers may be present in one or more of the tissue sheets 12. In some of these embodiments, the z-directional hydrophobic chemical additive gradient may be present in at least one of the tissue sheets 12. It may be desirable to have the z-directional hydrophobic chemical additive gradient in more than one of the tissue sheets 12. In one embodiment of the present invention, the structure of the tissue product 10 comprises at least two tissue sheets 12 and 12*a*, wherein the layers 14 and 22 comprise the selectively treated pulp fibers, thus having the highest levels of the hydrophobic chemical additive, forming the outer surfaces 30 and 32 of the tissue product 10. In this embodiment of the present invention, the inner tissue sheets 12 may comprise selectively non-treated pulp fibers.

In another embodiment of the present invention, the tissue product 10 may comprise hardwood and softwood kraft pulp fibers. In other embodiments of the present invention, at least one tissue sheet 12 may comprise hardwood and softwood kraft pulp fibers. It may be desirable in some embodiments for the selectively treated pulp fibers to comprise hardwood kraft pulp fibers. It may also be desirable in some embodiments of the present invention to position the selectively treated pulp fibers comprised of hardwood kraft pulp fibers in the at least one of the outer layers of the tissue sheets 12 that form the outer surfaces 30 and/or 32 of the tissue product 10. In variations of this embodiment of the present invention, the remaining layers of the tissue sheets 12 of the tissue product 10 may or may not comprise the selectively treated pulp fibers, the order of the layers and/or tissue sheets 12 may be varied in any order. Any number of additional layers and/or tissue sheets 12 may be employed in the tissue product 10 of the present invention. More specifically, according to one embodiment, the tissue product 10 is a single ply product. The tissue sheet 12 has a structure comprised of three layers 14, 16, and 18. The first outer layer 14 comprises the selectively treated pulp fibers comprised of hardwood kraft pulp fibers, forming the outer surface 30 of the tissue product 10. The inner layer 18 comprises selectively non-treated pulp fibers comprised of softwood kraft pulp fibers. The second outer layer 16 comprises selectively non-treated pulp fibers comprised of hardwood kraft pulp fibers, forming the outer surface 32 of the tissue product 10. In another embodiment of the present invention, the tissue sheet 12 has a structure comprised of three layers 14, 16, and 18. The first outer layer 14 comprises the selectively treated pulp fibers comprised of hardwood kraft pulp fibers, forming the outer surface 30 of the tissue product 10. The inner layer 18 comprises selectively non-treated pulp fibers comprised of hardwood kraft pulp fibers. The second outer layer 16 comprises selectively non-treated pulp fibers comprised of softwood kraft pulp fibers, forming the outer surface 32 of the tissue product 10.

In another embodiment of the present invention, the single ply tissue product 10 may comprise a three-layer tissue sheet 12 wherein the first and second outer layers 14 and 16, as shown in FIG. 1, comprise the selectively treated pulp fibers and the inner layer 18 comprises selectively non-treated pulp fibers. The structure of the tissue sheet 12 may be arranged such that there is the z-directional hydrophobic chemical additive gradient of the tissue sheet 12 measured from the outer surface 30 to the outer surface 32 of the tissue sheet 12 wherein the hydrophobic chemical additive content decreases at the center 40 of the tissue sheet 12 and increases at or adjacent the outer surfaces 30 and 32 of the tissue sheet 12. In some of the embodiments of the present invention, the inner layer 18 of the three-layer tissue sheet 12 of the single ply tissue product 10 has a hydrophobic chemical additive content of about 0%.

In some of the embodiments of the present invention, the tissue products 10 may have a high z-directional hydrophobic chemical additive gradient in the outer layer or layers 12 of the tissue product 10. The present invention may comprise a soft, absorbent single or multi-ply tissue product 10. Each tissue sheet 12 of the tissue product 10 have an outer surface 42 and an opposing outer surface 44. One or more of the tissue sheets 12 of the multi-ply tissue product 10 contains a hydrophobic chemical additive wherein the hydrophobic chemical additive is distributed non-uniformly in the z-direction of the tissue sheet 12. As one example, the level of the hydrophobic chemical additive, such as a polysiloxane, on or adjacent the outer surface 42 of the tissue sheet 12 as measured in terms of atomic % Si is different from the atomic % Si on or adjacent the opposing outer surface 44 of the tissue sheet 12. The atomic % Si on the surface comprising the highest atomic % Si may be about 3% or greater, more specifically about 4% or greater, and most specifically about 5% or greater. The z-directional hydrophobic chemical additive gradient, as calculated by the equation above and as defined above, between the outer surfaces 42 and 44 is about 20%, more specifically about 25% or greater, still more specifically about 30% or greater, and most specifically about 35% or greater.

Hydrophobic Chemical Additives

The term "hydrophobic" as used herein refers to materials having little to no solubility in water. The hydrophobic chemical additives of the present invention may have water solubilities of about 3 g/100 cc or less, still more specifically of about 1.5 grams/100 cc or less, and still most specifically of about 0.75 g/100 cc or less of deionized water. The term "solubility" as referred to herein refers to the solubility of the active hydrophobic chemical additive not including the vehicle in which the hydrophobic chemical additive is delivered. It is to be understood that some of these hydrophobic chemical additives may be made water dispersible with use of sufficient emulsifier additives although the specific active hydrophobic chemical additive is still water insoluble.

The hydrophobic chemical additive is not substantive or is poorly substantive to wet pulp fibers when the hydrophobic chemical additive is in the desorbed state. Substantivity to wet pulp fibers in the desorbed state would cause desorbed material to be absorbed by other pulp fibers not selectively treated and hence causing contamination of the selectively non-treated pulp fibers. However, in accordance with some embodiments of the present invention, the hydrophobic chemical additives, when added directly to an aqueous slurry of pulp fibers in the tissue making process at a consistency of about 2.5 percent and added at a rate of about 1% by weight of dry pulp fibers will have a retention of about 50% or less, more specifically about 40% or less, and still more specifically about 30% or less. However, the hydrophobic chemical additive may be applied as herein described to form selectively treated pulp fibers, when the selectively treated pulp fibers are slurried, dewatered, and dried to form a tissue sheet 12, the hydrophobic chemical additive may have a retention level of about 50% or greater, more specifically of about 60% or greater, and most specifically about 75% or greater.

Examples of hydrophobic chemical additives of the present invention may include, but are not limited to, polysiloxanes, mineral oil, other oils and waxes, aloe vera oil and extracts, tocopherols, such as Vitamin E, and other oil soluble vitamins, polypropylene glycols including amino functional materials such as the Jeffamine series of resins manufactured and sold by Hunstsman Chemical, Inc. located at Salt Lake City, Utah.

The amount of the hydrophobic chemical additive or combinations thereof on the selectively treated pulp fibers may range from about 0.01% to about 10%, more specifically from about 0.05% to about 5%, and still more specifically from about 0.1% to about 3% by weight of the dry selectively treated pulp fibers.

The total amount of hydrophobic chemical additive in a tissue sheet 12 (ply) comprising the selectively treated pulp fibers may vary greatly but may be from about 0.01% to about 5% by weight of the total dry pulp fiber weight of the tissue sheet 12, more specifically from about 0.02% to about 3% by weight of the total dry pulp fiber weight of the tissue sheet 12, and most specifically from about 0.03% to about 1.5% by weight of the total dry pulp fiber weight of the tissue sheet 12.

For tissue products 10 comprising a z-directional gradient of the hydrophobic chemical additive, the layer of the tissue sheet 12 comprising the selectively treated pulp fibers may constitute about 60% or less by weight of the tissue sheet 12, more specifically about 50% or less by weight of the tissue sheet 12, and still most specifically about 40% or less by weight of the tissue sheet 12 comprising the selectively treated pulp fibers. The weight of the selectively non-treated pulp fiber that is not located in the layer or layers comprising the selectively treated pulp fibers constitutes about 20% or more by weight of the tissue sheet 12, more specifically about 30% or more by weight of the tissue sheet 12, and still more specifically about 50% or more by weight of the tissue sheet 12 in which the selectively treated pulp fibers are located.

The hydrophobic chemical additive may be delivered to the pulp fibers during the manufacturing process of the selectively treated pulp fibers with the hydrophobic chemical additive may be any form known in the art as long as the manufacturing process does not enhance the ability of the hydrophobic chemical additive to become desorbed from the selectively treated pulp fibers and be readsorbed by selectively non-treated pulp fibers during the tissue making process. The hydrophobic chemical additives useful for the present invention may be delivered to the pulp fibers as neat fluids, non-aqueous solutions, aqueous or non-aqueous dispersions, emulsions, including microemulsions, stabilized by suitable surfactant systems that may or may not confer a charge to the emulsion micelles. To maximize retention of the hydrophobic chemical additives during the tissue manufacturing process, the hydrophobic chemical additives may be added without added surfactants, and most specific, the hydrophobic chemical additives are added to the pulp fiber as a neat fluid.

Pulp Fibers

A wide variety of natural and synthetic pulp fibers are suitable for use in the tissue sheets 12 and tissue products 10 of the present invention. The pulp fibers may include fibers formed by a variety of pulping processes, such as kraft pulp, sulfite pulp, thermomechanical pulp, etc. In addition, the pulp fibers may consist of any high-average fiber length pulp, low-average fiber length pulp, or mixtures of the same. Any of the natural pulp fibers species may be selectively treated with the hydrophobic chemical additive of the present invention.

One example of suitable high-average length pulp fibers include softwood kraft pulp fibers. Softwood kraft pulp fibers are derived from coniferous trees and include pulp fibers such as, but not limited to, northern softwood, southern softwood, redwood, red cedar, hemlock, pine (e.g., southern pines), spruce (e.g., black spruce), combinations thereof, and the like. Northern softwood kraft pulp fibers may be used in the present invention. One example of commercially available northern softwood kraft pulp fibers suitable for use in the present invention include those available from Kimberly-Clark Corporation located in Neenah, Wis. under the trade designation of "Longlac-19".

Another example of suitable low-average length pulp fibers are the so called hardwood kraft pulp fibers. Hardwood kraft pulp fibers are derived from deciduous trees and include pulp fibers such as, but not limited to, eucalyptus, maple, birch, aspen, and the like. In certain instances, eucalyptus kraft pulp fibers may be particularly desired to increase the softness of the tissue sheet 12. Eucalyptus kraft pulp fibers may also enhance the brightness, increase the opacity, and change the pore structure of the tissue sheet 12 to increase its wicking ability. Moreover, if desired, secondary pulp fibers obtained from recycled materials may be used, such as fiber pulp from sources such as, for example, newsprint, reclaimed paperboard, and office waste.

In one embodiment of the present invention, the selectively treated pulp fibers may be of low average length, comprising hardwood kraft pulp fibers and may be of a single species such as eucalyptus, maple, birch, aspen or blends of various hardwood species thereof. Typically, the outer layers (such as 14 and 16) of the tissue sheet or sheets 12 that comprise the selectively treated pulp fibers may be comprised primarily of hardwood kraft pulp fibers. However, in other embodiments, the selectively treated hardwood kraft pulp fibers may be combined with an amount of softwood kraft pulp fibers within the layer comprising the hardwood kraft pulp fibers.

The overall ratio of hardwood kraft pulp fibers to softwood kraft pulp fibers in the tissue product 10, including tissue sheets 12 not comprising the selectively treated pulp fibers may vary broadly. However, for a soft tissue sheet 12, one structure comprises a blend of hardwood kraft pulp fibers and softwood kraft pulp fibers wherein the ratio of hardwood kraft pulp fibers to softwood kraft pulp fibers is from about 9:1 to about 1:9, more specifically from about 9:1 to about 1:4, and most specifically from about 9:1 to about 1:3. Subject to the constraints previously disclosed for the selectively treated pulp fibers, within a tissue sheet 12, the hardwood kraft pulp fibers and softwood kraft pulp fibers may be blended prior to forming the tissue sheet 12 thereby producing a homogenous distribution of hardwood kraft pulp fibers and/or softwood kraft pulp fibers in the z-direction of the tissue sheet 12. In a specific embodiment, the hardwood kraft pulp fibers and softwood kraft pulp fibers are layered so as to give a heterogeneous distribution of hardwood kraft pulp fibers and softwood kraft pulp fibers in the z-direction of the tissue sheet 12. In one embodiment, the hardwood kraft pulp fibers are located in the outer layers of the tissue product 10 with the inner layer or layers comprising the softwood kraft pulp fibers.

In addition, synthetic fibers may also be utilized in the present invention. The discussion herein regarding pulp fibers not treated with the hydrophobic chemical additives is understood to include synthetic fibers. Some suitable polymers that may be used to form the synthetic fibers include, but are not limited to: polyolefins, such as, polyethylene, polypropylene, polybutylene, and the like; polyesters, such as polyethylene terephthalate, poly(glycolic acid) (PGA), poly(lactic acid) (PLA), poly(β-malic acid) (PMLA), poly (ε-caprolactone) (PCL), poly(ρ-dioxanone) (PDS), poly(3-hydroxybutyrate) (PHB), and the like; and, polyamides, such as nylon and the like. Synthetic or natural cellulosic polymers, including but not limited to: cellulosic esters; cellulosic ethers; cellulosic nitrates; cellulosic acetates; cellulosic acetate butyrates; ethyl cellulose; regenerated celluloses, such as viscose, rayon, and the like; cotton; flax; hemp; and mixtures thereof may be used in the present invention. The synthetic fibers may be located in the layers of the tissue sheet 12 comprising hydrophobic chemical additive selectively treated pulp fibers, the layers of the tissue sheet 12 comprising non-treated pulp fibers, or in any or all layers of the tissue sheet 12. As discussed for tissue sheets 12, in multi-ply tissue products 10 of the present invention, the synthetic fibers may be located in any or all tissue sheets 12 of the multi-ply tissue product 10.

Polysiloxanes

The particular structure of the polysiloxanes of the present invention may provide the desired product properties to the tissue sheet 12 and/or tissue product 10. Functional and non-functional polysiloxanes are suitable for use in the present invention. Polysiloxanes encompass a very broad class of compounds. They are characterized in having a backbone structure:

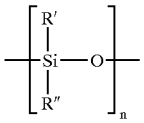

where R' and R" may be a broad range of organo and non-organo groups including mixtures of such groups and where n is an integer ≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers. The scope of the present invention should not be construed as limited by a particular polysiloxane structure so long as that polysiloxane structure delivers the aforementioned product benefits to the tissue sheet and/or the final tissue product.

A specific class of polysiloxanes suitable for use in the present invention may have the general formula:

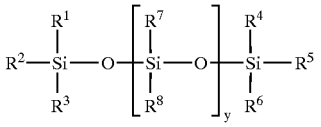

wherein the $R^1$–$R^8$ moieties may be independently any organofunctional group including $C_1$ or higher alkyl groups, aryl groups, ethers, polyethers, polyesters, amines, imines, amides, or other functional groups including the alkyl and alkenyl analogues of such groups and y is an integer >1. Specifically, the $R^1$–$R^8$ moieties may be independently any $C_1$ or higher alkyl group including mixtures of said alkyl groups. Examples of polysiloxanes that may be useful in the present invention are those in the DC-200 fluid series, manufactured and sold by Dow Corning, Inc., located in Midland, Mich.

Functionalized polysiloxanes and their aqueous emulsions are typically commercially available materials. These amino functional polysiloxanes having the general following structure may be useful in the present invention:

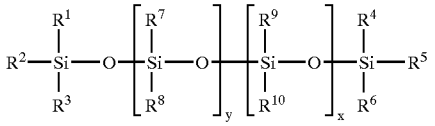

wherein, x and y are integers >0. The mole ratio of x to (x+y) may be from about 0.005 percent to about 25 percent. The $R^1$–$R^9$ moieties may be independently any organofunctional group including $C_1$ or higher alkyl groups, aryl groups, ethers, polyethers, polyesters, amines, imines, amides, or other functional groups including the alkyl and alkenyl analogues of such groups. The $R^{10}$ moiety may be an amino functional moiety including but not limited to primary amine, secondary amine, tertiary amines, quaternary amines, unsubstituted amides and mixtures thereof. In one embodiment, the $R^{10}$ moiety may comprise at least one amine group per constituent or two or more amine groups per substituent, separated by a linear or branched alkyl chain of $C_1$ or greater. Examples of some polysiloxanes that may be useful in the present invention include, but are not limited to, DC 2-8220 commercially available from Dow Corning, Inc., locate at Midland, Mich., DC 2-8182 commercially available from Dow Corning, Inc., located at Midland, Mich., and Y-14344 commercially available from Crompton, Corp., located at Greenwich, Conn.

Another class of functionalized polysiloxanes that may be suitable for use in the present invention is the polyether polysiloxanes. Such polysiloxanes may be used with other functional polysiloxanes as a means of improving hydrophilicity of the polysiloxane treated tissue products. Such polysiloxanes generally have the following structure:

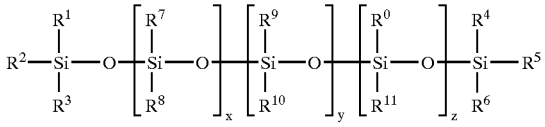

wherein, x and z are integers >0. y is an integer ≧0. The mole ratio of x to (x+y+z) may be from about 0.05 percent to about 95 percent. The ratio of y to (x+y+z) may be from about 0 percent to about 25%. The $R^0$–$R^9$ moieties may be independently any organofunctional group including $C_1$ or higher alkyl groups, aryl groups, ethers, polyethers, polyesters, amines, imines, amides, or other functional groups including the alkyl and alkenyl analogues of such groups. The $R^{10}$ moiety may be an amino functional moiety including, but not limited to, primary amine, secondary amine, tertiary amines, quaternary amines, unsubstituted amides, and mixtures thereof. An exemplary $R^{10}$ moiety may contain one amine group per constituent or two or more amine groups per substituent, separated by a linear or branched alkyl chain of $C^1$ or greater. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$ alkyl groups, linear or branched; $R^{15}$ may be H or a $C_{1-30}$ alkyl group; and, "a" and "b" are integers of from about 1 to about 100, more specifically from about 5 to about 30. Examples of amino-functional polysiloxanes that may be useful in the present invention include the polysiloxanes provided under the trade designation of Wetsoft CTW family manufactured and sold by Wacker, Inc., located Adrian, Mich. Other examples of such polysiloxanes may be found in U.S. Pat. No. 6,432,270, issued on Aug. 13, 2002 to Liu, et al., the disclosure of which is incorporated herein by reference to the extent that it is non-contradictory herewith.

Preparation of Selectively Treated Fibers

The preparation of selectively treated pulp fibers may be accomplished by methods such as those described in co-pending U.S. patent application Ser. No. 09/802,529 filed on Apr. 3, 2001 under Runge et al. It has been found that pulp fibers treated with hydrophobic chemical additives in this manner demonstrate excellent retention of the hydrophobic chemical additives through the tissue making process. Furthermore, it has been found that a hydrophobic chemical additive which may be desorbed from the pulp fibers during the tissue making process has little to no tendency to be adsorbed by selectively non-treated pulp fibers. The selectively treated pulp fibers may contain from about 0.1% to about 10% hydrophobic chemical additive by weight, more specifically from about 0.2% to about 4% hydrophobic chemical additive by weight, and most specifically from about 0.3% to about 3% hydrophobic chemical additive by weight. Using a stratified headbox to make a multi-layered tissue sheet 12 comprising selectively treated pulp fibers, the tissue sheets 12 may be used to produce tissue products 10 containing hydrophobic chemical additive distributed non-uniformly in the z-direction of the tissue sheet 12.

The selectively treated pulp fibers may be directed towards at least one of the outer surfaces 30 and 32 formed by the outer layers (such as 14 and 16 as shown in FIG. 1 or 14 and 22 as shown in FIG. 2) adjacent the outer surfaces 30 and 32 of the multi-layered tissue sheet 12. The layer of the multi-layer tissue sheet 12 comprising the selectively treated pulp fibers may constitute about 60% or less by of the weight of the total tissue sheet, more specifically about 50% or less by weight of the total tissue sheet, and still more specifically about 40% or less by weight of the total tissue sheet. The selectively treated pulp fibers may be blended with any of various selectively non-treated pulp fibers before being formed into the multi-layered tissue sheet 12. The selectively treated pulp fibers may constitute from about 5% to about 100% of the pulp fibers in the layer of the tissue sheet 12 comprising the selectively treated pulp fibers, more specifically from about 5% to about 90% of the pulp fibers in the layer comprising the selectively treated pulp fibers, and most specifically from about 10% to about 90% of the pulp fibers in the layer comprising the selectively treated pulp fibers.

Methods of Application

The hydrophobic chemical additives may be applied to the pulp fibers in any form so long as the claimed product benefits are not compromised. The hydrophobic chemical additive may be delivered to the pulp fibers as an aqueous emulsion or dispersion, a solution in an organic fluid or non-organic fluid medium, or as a neat hydrophobic chemical additive comprising no added solvents, emulsifiers, or other agents.

The method by which the hydrophobic chemical additive may be added to the pulp fibers to form the selectively treated pulp fibers may be any method known in the art to accomplish the present invention. In accordance with one embodiment, the pulp fibers may be dried to a consistency of about 95% or greater subsequent to the application of the hydrophobic chemical additive to the pulp fibers and prior to the pulp fibers being redispersed in water at the tissue machine. The hydrophobic chemical additive may be added to the pulp fibers at the pulp mill in one embodiment. The pulp fibers may be only once dried prior to being dispersed during the tissue making process. Other embodiments of the present invention for adding the hydrophobic chemical additives to the pulp fibers may include, but are not limited to, processes that incorporate comminuted or flash dried pulp fibers being entrained in an air stream combined with an aerosol or spray of the hydrophobic chemical additive so as to treat individual pulp fibers prior to incorporation into the tissue sheet 12 and/or tissue product 10. Other embodiments involving secondary processes may be envisioned and should be considered as within the scope of the present invention. Examples of such processes include, but are not limited to:

- Preparing a slurry of non-selectively treated, once dried pulp fibers, dewatering and optionally drying the slurried selectively non-treated pulp fibers to form a partially dried or dried web of selectively non-treated pulp fibers, treating said partially dried or dried web of selectively non-treated pulp fibers with a hydrophobic chemical additive to form a partially dried or dried hydrophobic chemical additive treated pulp fiber web, further drying said partially dried or dried hydrophobic chemical additive treated pulp fiber web to form a dried hydrophobic chemical additive treated pulp fiber web containing hydrophobic chemical additive selectively treated pulp fibers.
- Applying a hydrophobic chemical additive directly to a roll of dried or partially dried pulp fibers to form a roll of selectively treated pulp fibers.

It should be understood that while such secondary processes may be used to selectively treat the pulp fibers with the hydrophobic chemical additive that utilizing such processes is undertaken with a significant economic penalty to the overall tissue product characteristics or properties.

The application of hydrophobic chemical additive to the partially dried or dried pulp fiber web to form the selectively treated pulp fibers can be done by any method known in the art including but not limited to:

- Contact printing methods such as gravure, offset gravure, flexographic printing and the like.
- A spray applied to the pulp fiber web. For example, spray nozzles may be mounted over a moving tissue web to apply a desired dose of a solution to the moist web. Nebulizers may also be used to apply a light mist to a surface of a pulp fiber web.
- Non-contact printing methods such as ink jet printing, digital printing of any kind, and the like.
- Coating onto one or both surfaces of the pulp fiber web, such as blade coating, air knife coating, short dwell coating, cast coating, size presses and the like.
- Extrusion from a die head such as UFD spray tips, such as those available from ITW-Dynatec located at Henderson, TN, of the hydrophobic chemical additive in the form of a solution, a dispersion or emulsion, or a viscous mixture.
- Foam application of the hydrophobic chemical additive to the moist pulp fiber web (e.g., foam finishing), either for topical application or for impregnation of the hydrophobic chemical additive into the pulp fiber web under the influence of a pressure differential (e.g., vacuum-assisted impregnation of the foam). Principles of foam application of hydrophobic chemical additives are described in U.S. Pat. No. 4,297,860, issued on Nov. 3, 1981 to Pacifici et al. and U.S. Pat. No. 4,773,110, issued on Sep. 27, 1988 to G. J. Hopkins, both of which are herein incorporated by reference to the extent that they are non-contradictory herewith.

Application of the hydrophobic chemical additive by spray or other means to a moving belt or fabric which in turn contacts the pulp fiber web to apply the chemical to the pulp fiber web, such as is disclosed in WO 01/49937 under the name S. Eichhorn, published on Jun. 12, 2001.

Tissue Preparation

At the tissue machine, the dried selectively treated pulp fibers are mixed with water to form one pulp fiber slurry comprising selectively treated pulp fibers wherein the hydrophobic chemical additive may be retained by individual pulp fibers coated with hydrophobic chemical additive. Selectively non-treated pulp fibers may also be added to the pulp fiber slurry comprising the selectively treated pulp fibers. The pulp fiber slurry may then be forwarded to a single layered headbox, deposited onto a moving wire or belt, dewatered, dried and processed to form a blended tissue sheet 12 comprising the selectively treated pulp fibers.

Optionally, one or more additional pulp fiber slurries comprising selectively non-treated pulp fibers may be prepared in the same manner as the pulp fiber slurry comprising the selectively treated pulp fibers. The pulp fiber slurry comprising the selectively treated pulp fibers and the slurry or slurries comprising the selectively non-treated pulp fibers may be then passed to a stratified headbox. The pulp fiber slurries are then deposited from the stratified headbox onto a moving wire or belt, wherein the slurry comprising the selectively treated pulp fibers may be directed to one or both of the outer layers of the stratified headbox. The tissue sheet 12 is then dewatered, dried and processed to form a dried layered tissue sheet 12 which may be converted into a tissue product 10 comprising the selectively treated pulp fibers.

The tissue sheet 12 to be treated may be made by any method known in the art. The tissue sheet 12 may be wetlaid, such as a tissue sheet formed with known papermaking techniques wherein a dilute aqueous fiber slurry is disposed on a moving wire to filter out the fibers and form an embryonic tissue sheet which is subsequently dewatered by combinations of units including suction boxes, wet presses, dryer units, and the like. Examples of known dewatering and other operations are given in U.S. Pat. No. 5,656,132, issued on Aug. 12, 1997 to Farrington, Jr. et al. Capillary dewatering may also be applied to remove water from the tissue sheet, as disclosed in U.S. Pat. No. 5,598,643, issued on Feb. 4, 1997 and U.S. Pat. No. 4,556,450, issued on Dec. 3, 1985, both to S. C. Chuang et al., the disclosures of both which are herein incorporated by reference to the extent that they are non-contradictory herewith.

For the tissue sheets 12 of the present invention, both creped and uncreped methods of manufacture may be used. Uncreped tissue production is disclosed in U.S. Pat. No. 5,772,845, issued on Jun. 30, 1998 to Farrington, Jr. et al., the disclosure of which is herein incorporated by reference to the extent it is non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., the disclosures of all of which are herein incorporated by reference to the extent that they are non-contradictory herewith. Also suitable for application of the above mentioned polysiloxanes are tissue sheets 12 that are pattern densified or imprinted, such as the webs disclosed in any of the following U.S. Pat. No. : 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steltjes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996 to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of all of which are herein incorporated by reference to the extent that they are non-contradictory herewith. Such imprinted tissue sheets 12 may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet 12 superposed over the deflection conduits was deflected by an air pressure differential across the deflection conduit to form a lower-density pillow-like region or dome in the tissue sheet 12.

Various drying operations may be useful in the manufacture of the tissue products 10 of the present invention. Examples of such drying methods include, but are not limited to, drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued on Nov. 7, 2000 to Hada et al., the disclosures of both which are herein incorporated by reference to the extent they are non-contradictory herewith. Also relevant are the paper machines disclosed in U.S. Pat. No. 5,230,776, issued on Jul. 27, 1993 to I. A. Andersson et al.

Optional Chemical Additives

Optional chemical additives may also be added to the aqueous pulp fiber slurries of the present invention and/or to the embryonic tissue sheet 12 to impart additional benefits to the tissue product 10 and process and are not antagonistic to the intended benefits of the present invention. The following chemical additives are examples of additional chemical treatments that may be applied to the tissue sheets 12 comprising the selectively treated pulp fibers. The chemical additives are included as examples and are not intended to limit the scope of the present invention. Such chemical additives may be added at any point in the papermaking process, before or after the formation of the tissue sheet 12 . The chemical additives may also be added with the hydrophobic chemical additive during the treatment of pulp fibers thereby forming the selectively treated pulp fibers, therefore the optional chemical additives may be added in conjunction with the selectively treated pulp fibers. The optional chemical additives may be added at any point in the tissue making process, before, after, or concurrent with the addition of the hydrophobic chemical additives of the present invention as well. The chemical additives may be blended directly with the hydrophobic chemical additives. Optionally, the optional chemical additives may be applied to the selectively non-treated pulp fibers during the pulping process.

It is also understood that the optional chemical additives may be employed in specific layers of the tissue sheet 12 or may be employed throughout the tissue sheet 12 as broadly known in the art. For example, in a layered tissue sheet configuration, strength agents may be applied only to the layer of the tissue sheet 12 comprising softwood kraft pulp fibers and/or bulk debonders may be applied only to the layer of the tissue sheet 12 comprising hardwood kraft pulp fibers. While significant migration of the chemical additives into the other untreated layers of the tissue sheet 12 may occur, benefits may be further realized than when the optional chemical additives are applied to all layers of the tissue sheet 12 on an equal basis. Such layering of the optional chemical additives may be useful in the present invention.

Charge Control Agents

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight less than 500,000. Drainage and retention aids may also be added to the furnish to improve formation, drainage and fines retention. Included within the retention and drainage aids are microparticle systems containing high surface area, high anionic charge density materials.

Strength Additives

Wet and dry strength agents may also be applied to the tissue sheet 12 . As used herein, the term "wet strength agents" are materials used to immobilize the bonds between pulp fibers in the wet state. Typically, the means by which pulp fibers are held together in tissue sheets and tissue products involve hydrogen bonds and sometimes combinations of hydrogen bonds and covalent and/or ionic bonds. In the present invention, it may be useful to provide a material that will allow bonding of pulp fibers in such a way as to immobilize the fiber-to-fiber bond points and make the pulp fibers resistant to disruption in the wet state. In this instance, the wet state usually will mean when the tissue sheet or tissue product is largely saturated with water or other aqueous solutions, but could also mean significant saturation with body fluids such as urine, blood, mucus, menses, runny bowel movement, lymph and other body exudates.

Any material that when added to a tissue sheet or tissue product results in providing the tissue sheet or tissue product with a mean wet geometric tensile strength:dry geometric tensile strength ratio in excess of 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into tissue sheets or tissue products, will provide a tissue product that retains more than about 50% of its original wet strength after being saturated with water for a period of at least five minutes. Temporary wet strength agents are that provide a tissue product that retains less than about 50% of its original wet strength after being saturated with water for five minutes. Both classes of material may find application in the present invention. The amount of wet strength agent that may be added to the pulp fibers may be about 0.1 dry weight percent or greater, more specifically about 0.2 dry weight percent or greater, and still more specifically from about 0.1 to about 3 dry weight percent, based on the dry weight of the pulp fibers.

Permanent wet strength agents will provide a more or less long-term wet resilience to the structure of a tissue sheet or tissue product. In contrast, the temporary wet strength agents will typically provide tissue sheet or tissue product structures that had low density and high resilience, but would not provide a structure that had long-term resistance to exposure to water or body fluids.

Wet and Temporary Wet Strength Additives

Temporary wet strength additives may be cationic, nonionic or anionic. Examples of such temporary wet strength additives include PAREZ™ 631 NC and PAREZ® 725 temporary wet strength resins that are cationic glyoxylated polyacrylamides available from Cytec Industries, located at West Paterson, N.J. These and similar resins are described in U.S. Pat. No. 3,556,932, issued on Jan. 19, 1971 to Coscia et al. and U.S. Pat. No. 3,556,933, issued on Jan. 19, 1971 to Williams et al. Hercobond 1366, manufactured by Hercules, Inc. located at Wilmington, Del. is another commercially available cationic glyoxylated polyacrylamide that may be used with the present invention. Additional examples of temporary wet strength additives include dialdehyde starches such as Cobond 1000® commercially available from National Starch and Chemical Company and other aldehyde containing polymers such as those described in U.S. Pat. No. 6,224,714, issued on May 1, 2001 to Schroeder et al.; U.S. Pat. No. 6,274,667, issued on Aug. 14, 2001 to Shannon et al.; U.S. Pat. No. 6,287,418, issued on Sep. 11, 2001 to Schroeder et al.; and, U.S. Pat. No. 6,365,667, issued on Apr. 2, 2002 to Shannon et al., the disclosures of all of which are herein incorporated by reference to the extent that they are non-contradictory herewith.

Permanent wet strength agents comprising cationic oligomeric or polymeric resins may be used in the present invention. Polyamide-polyamine-epichlorohydrin type resins such as KYMENE 557H sold by Hercules, Inc. located at Wilmington, Del. are the most widely used permanent wet-strength agents and are suitable for use in the present invention. Such materials have been described in the following U.S. Pat. No. 3,700,623, issued on Oct. 24, 1972 to Keim; U.S. Pat. No. 3,772,076, issued on Nov. 13, 1973 to Keim; U.S. Pat. No. 3,855,158, issued on Dec. 17, 1974 to Petrovich et al.; U.S. Pat. No. 3,899,388, issued on Aug. 12 , 1975 to Petrovich et al.; U.S. Pat. No. 4,129,528, issued on Dec. 12 , 1978 to Petrovich et al.; U.S. Pat. No. 4,147,586, issued on Apr. 3, 1979 to Petrovich et al.; and, U.S. Pat. No. 4,222,921, issued on Sep. 16, 1980 to van Eenam. Other cationic resins include polyethylenimine resins and aminoplast resins obtained by reaction of formaldehyde with melamine or urea. Permanent and temporary wet strength resins may be used together in the manufacture of tissue sheets and tissue products with such use being recognized as falling within the scope of the present invention.

Dry Strength Additives

Dry strength resins may also be applied to the tissue sheet without affecting the performance of the disclosed hydrophobic chemical additives of the present invention. Such materials may include, but are not limited to, modified starches and other polysaccharides such as cationic, amphoteric, and anionic starches and guar and locust bean gums, modified polyacrylamides, carboxymethylcellulose, sugars, polyvinyl alcohol, chitosan, and the like. Such dry strength additives are typically added to the pulp fiber slurry prior to the formation of the tissue sheet or as part of the creping package.

Additional Softness Additives

It may be desirable to add additional debonders or softening chemistries to a tissue sheet. Such softness additives may be found to further enhance the hydrophilicity of the finished tissue product. Examples of debonders and softening chemistries may include the simple quaternary ammonium salts having the general formula $(R^{1'})_{4-b}$—$N^+$—$(R^{1''})_b$ $X^-$ wherein $R^{1'}$ is a $C_{1-6}$ alkyl group, $R^{1''}$ is a $C_{14}$–$C_{22}$ alkyl group, b is an integer from 1 to 3 and $X^-$ is any suitable counterion. Other similar compounds may include the monoester, diester, monoamide, and diamide derivatives of the simple quaternary ammonium salts. A number of variations on these quaternary ammonium compounds should be considered to fall within the scope of the present invention. Additional softening compositions include cationic oleyl imidazoline materials such as methyl-1-oleyl amidoethyl-2-oleyl imidazo linium methylsulfate commercially available as Mackernium DC-183 from McIntyre Ltd., located in University Park, Ill. and Prosoft TQ-1003 available from Hercules, Inc. located at Wilmington, Del. Such softeners may also incorporate a humectant or a plasticizer such as a low molecular weight polyethylene glycol (molecular weight of about 4,000 daltons or less) or a polyhydroxy compound such as glycerin or propylene glycol. These softeners may be applied to the pulp fibers while in a pulp fiber slurry prior to the formation of a tissue sheet to aid in bulk softness. Additional bulk softening agents suitable for addition to the slurry of pulp fibers include cationic polysiloxanes such as those described in U.S. Pat. No. 5,591,306, issued on Jan. 7, 1997 to Kaun and U.S. Pat. No. 5,725,736, issued on Mar. 10, 1998 to Schroeder, the disclosures of both which are herein incorporated by reference to the extend that they are non-contradictory herewith. At times, it may be desirable to add such secondary softening agents simultaneously with the hydrophobic chemical additives of the present invention. In such cases, solutions or emulsions of the softening composition and hydrophobic chemical additive may be blended.

Miscellaneous Agents

Additional types of chemical additives that may be added to the tissue sheet include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin e and the like may also be incorporated into the tissue sheet.

In general, the selectively treated pulp fibers of the present invention may be used in conjunction with any known materials and chemical additives that are not antagonistic to their intended use. Examples of such materials include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, humectants, emollients, and the like. A wide variety of other materials and chemical additives known in the art of tissue-making production may be included in the tissue sheets of the present invention.

The application point for these materials and chemical additives is not particularly relevant to the invention and such materials and chemical additives may be applied at any point in the tissue manufacturing process. This includes pre-treatment of pulp, application in the wet end of the process, post-treatment after drying but on the tissue machine and topical post-treatment.

Analytical Methods

Fractionation of Samples of Tissue Sheets

Samples of tissue sheets were fractionated according to the following procedure. About 100 grams of a tissue sheet was dispersed in a British Disintegrator, available from Lorentzen and Werte, Inc., located in Atlanta, Ga. for about 15 minutes at about 3% solids (other conditions as appropriate). The pulp fiber was then fractionated using a Bauer McNett classifier. Two fractions of the pulp fibers were recovered, the long pulp fiber fraction was composed of pulp fibers that could not pass a 20 mesh screen and the short pulp fiber fraction was composed of pulp fibers that passed the 20 mesh screen but not a 200 mesh screen. The two fractions of the pulp fibers were dried for about 2 hours at about 105° C. The amount of hydrophobic chemical additive as a % by weight of dry pulp fiber each fraction of the pulp fibers was then determined.

Substantivity of Hydrophobic Chemical Additive

The substantivity of the hydrophobic chemical additive on the selectively treated pulp fibers was determined in the following manner. About 25 grams of the eucalyptus hardwood kraft pulp fibers selectively treated with the hydrophobic chemical additive were dispersed in 2000 cc of distilled water at about 40° F. for about 5 minutes in a British Pulp Disintegrator available from Lorentzen and Werte, Inc., located in Atlanta, Ga. The pulp fiber slurry is then diluted to about 0.3% consistency. The appropriate amount of the about 0.3% pulp fiber slurry to form an about 60 gsm tissue sheet is poured into a square (9"×9") Valley Handsheet Mold available from Voith, Inc., located in Appleton, Wis. The mold was partially filled with water. The mold was then filled to about 8-liters total volume with water. The pulp fibers suspended in the handsheet mold water were then mixed using a perforated plate attached to a handle to uniformly disperse the pulp fibers within the entire volume of the mold. After mixing, the tissue sheet was formed by draining the water in the mold, thus depositing the fibers on the 90×90 mesh forming wire. The tissue sheet was removed from the forming wire using blotters and a couch roll. The wet tissue sheet was then pressed wire side up at about 100 PSI for about 2 minutes and then transferred to a steam heated, convex surface metal dryer (such as a Valley Steam Hotplate dryer available from Voith, Inc., located in Appleton, Wis.) maintained at about 213° F.±2° F. The tissue sheet was held against the dryer by use of a canvas under tension. The tissue sheet was allowed to dry for about 2 minutes on the metal surface of the dryer. The tissue sheet was then removed from the dryer. The content of the hydrophobic chemical additive in the selectively treated pulp fibers before and after the hand tissue sheet preparation was then determined. The substantivity is expressed in terms of the following equation:

$$\text{Substantivity}=(A)/(B)\times 100\%$$

A=% hydrophobic chemical additive in hand tissue sheet

B=% hydrophobic chemical additive in the selectively treated pulp fibers

Wet End Chemical Substantivity

The substantivity of the hydrophobic chemical additive when applied directly in the wet end of the tissue making process was determined by the following procedure. About 50 grams of the eucalyptus hardwood pulp fibers selectively treated with the hydrophobic chemical additive was dispersed in about 2000 cc of distilled water at approximately 40° F. for about 5 minutes in a British Pulp Disintegrator available from Lorentzen and Werte, Inc., located in Atlanta, Ga. The pulp fiber slurry was transferred to a mixing vessel and stirred with a mechanical mixer under moderate shear. The hydrophobic chemical additive was then added to the pulp fiber slurry at a level of about 1 pound dry weight of the hydrophobic chemical additive per 100 pounds of dry pulp fiber. The pulp fibers and hydrophobic chemical additive were then mixed for a period of about 5 minutes. The pulp fiber slurry was then diluted to about 0.6% consistency. The appropriate amount of the 0.6% pulp fiber slurry to form a 60 gsm hand tissue sheet was poured into a square (9"×9") Valley Handsheet Mold available from Voith, Inc., located in Appleton, Wis. The mold was partially filled with water. The mold was then filled to about 8-liters total volume with water. The pulp fibers suspended in the handsheet mold water are then mixed using a perforated plate attached to a handle to uniformly disperse the pulp fibers within the entire volume of the mold. After mixing, the tissue sheet was formed by draining the water in the mold, thus depositing the pulp fibers on the 90×90 mesh forming wire. The tissue sheet was removed from the forming wire using blotters and a couch roll. The wet tissue sheet was then pressed wire side up at about 100 PSI for about 2 minutes and then transferred to a steam heated, convex surface metal dryer (such as a Valley Steam Hotplate dryer available from Voith, Inc., located in Appleton, Wis.) maintained at 213° F.±2° F. The tissue sheet was held against the dryer by use of a canvas under tension. The tissue sheet was allowed to dry for about 2 minutes on the metal surface of the dryer. The tissue sheet was then removed from the dryer. The content of the hydrophobic chemical additive in the selectively treated pulp fibers before and after hand tissue sheet preparation was determined. The substantivity is expressed in terms of the following equation:

$$\text{Substantivity}=(\%\ \text{additive in Handsheet})/(1.00)\times 100\%$$

Determination of Atomic % Silicon

X-ray photoelectron spectroscopy (XPS) is a method used to analyze certain elements lying on the surface of a material. Sampling depth is inherent to XPS. Although the x-rays can penetrate the sample microns, only those electrons that originate at the outer ten Angstroms below the solid surface can leave the sample without energy loss. It is these electrons that produce the peaks in XPS. The electrons that interact with the surrounding atoms as they escape the surface form the background signal. The sampling depth is defined as 3 times the inelastic mean free path (the depth at which 95% of the photoemission takes place), and is estimated to be 50–100 angstroms. The mean free path is a function of the energy of the electrons and the material that they travel through.

The flux of photoelectrons that come off the sample, collected, and detected is elemental and instrumental dependant. It is not overly critical to the results as herein expressed. The atomic sensitivity factors are various constants for each element that account for these variables. The atomic sensitivity factors are supplied with the software from each XPS instrument manufacturer. Those skilled in the art will understand the need to use the set of atomic sensitivity factors designed for their instrument. The atomic sensitivity factor (S) is defined by the equation:

$$S=f\sigma\theta y\lambda AT \text{ and is a constant for each photoelectron.}$$

f=x-ray flux
σ=photoelectron cross-section
θ—angular efficiency factor
y=efficiency in the photoelectron process
λ=mean free path
A=area of sample
T=detection efficiency Atomic concentrations are determined by the following equation:

$$C_x=I_x/S_x/(\Sigma I_i/S_i)$$

Cx=atomic fraction of element x
Ix=peak intensity of photoelectron of element x
Sx=atomic sensitivity factor for photoelectron of element x XPS was used to determine the z-directional polysiloxane gradient. An approximately 1 cm×1 cm sample was cut from a tissue sheet comprising polysiloxane selectively treated pulp fibers and cut in ½ to provide two 1 cm×0.5 cm specimens of the tissue sheet. Analysis of the surfaces of the specimens of the tissue sheet was conducted on a representative portion of each specimen, approximately 1cm×0.5 cm. The specimens were mounted on a sample holder using double sided tape such as Scotch Brand Double Stick Tape, 3M Corp., Minneapolis, Minn. An equivalent tape may be used provided that the equivalent tape does not contain silicones and does not off-gas to an appreciable extent. Tape size is not overly critical, but should be slightly larger than the sample size to prevent having to pump on extraneous material. One of the two specimens cut from the 1 cm×1 cm square is used to measure the top outer surface of the tissue sheet and the other specimen is used to measure the bottom outer surface of the tissue sheet. Three sample points are tested for each of the specimens representing the top and bottom outer surfaces and the average of the three sample points is reported.

The samples were analyzed utilizing a Fisons M-Probe XPS spectrometer equipped with monochromatic Al Ka x-rays, using an analysis region of about 1 $mm^2$. Charge neutralization was accomplished using the electron flood gun/screen (FGS) method. Atomic sensitivity factors, supplied with the Fisons M-Probe spectrometer, were used to establish the relative atomic concentration of the elements detected by the spectrometer. The atomic Si concentration is used to define the level of polysiloxane on the outer surfaces of the tissue sheet.

Total Polysiloxane in Sheet

The polydimethyl siloxane content on the pulp fiber substrates was determined using the following procedure. A sample containing dimethyl siloxane is placed in a headspace vial, boron trifluoride reagent is added, and the vial sealed. After reacting for about fifteen minutes at about 100° C., the resulting Diflourodimethyl siloxane in the headspace of the vial is measured by gas chromatography using an FID detector.

$$3\ Me_2SiO+2\ BF_3.O(C_2H_5)_2 \rightarrow 3\ Me_2SiF_2+B_2O_3+2(C_2H_5)_2O$$

The method described herein was developed using a Hewlett-Packard Model 5890 Gas Chromatograph with an FID and a Hewlett-Packard 7964 autosampler. An equivalent gas chromatography system may be substituted.

The instrument was controlled by, and the data collected using, Perkin-Elmer Nelson Turbochrom software (version 4.1). An equivalent software program may be substituted. A J&W Scientific GSQ (30 m×0.53 mm i.d.) column with film thickness 0.25 μm, Cat. #115-3432 was used. An equivalent column may be substituted.

The gas chromatograph was equipped with a Hewlett-Packard headspace autosampler, HP-7964 and set up at the following conditions

| | |
|---|---|
| Bath Temperature: | 100° C. |
| Transfer Line Temperature: | 120° C. |
| Vial Equilibrium Time: | 15 minutes |
| Loop Fill Time: | 0.2 minutes |
| Inject Time: | 1.0 minute |
| Loop Temperature: | 110° C. |
| GC Cycle Time: | 25 minutes |
| Pressurize Time: | 0.2 minutes |
| Loop Equil. Time: | 0.05 minutes |
| Vial Shake: | 1 (Low) |

The Gas Chromatograph was set to the following instrument conditions:

Carrier gas: Helium

Flow rate: 16.0 mL through column and 14 mL make-up at the detector.

Injector Temperature: 150° C.

Detector Temperature: 220° C.

Chromatography Conditions:

50° C. for 4 minutes with a ramp of 10° C./minute to 150° C.

Hold at final temperature for 5 minutes.

Retention Time: 7.0 min. for DFDMS

Preparation of Stock Solution

The method is calibrated to pure PDMS using DC-200 fluid available from Dow Corning, located in Midland, Mich. A stock solution containing about 1250 μg/ml of the DC-200 fluid is prepared in the following manner. About 0.3125 grams of the DC-200 fluid is weighed to the nearest 0.1 mg into a 250-ml volumetric flask. The actual weight (represented as X) is recorded. A suitable solvent such as methanol, MIBK or chloroform is added and the flask swirled to dissolve/disperse the fluid. When dissolved, the solution is diluted to volume with solvent and mixed. The ppm of polysiloxane (represented as Y) is calculated from the following equation:

$$PPM \text{ polysiloxane emulsion } Y=X/0.250$$

Preparation of Calibration Standards

The Calibration Standards are made to bracket the target concentration by adding 0 (blank), 50, 100, 250, and 500 μL of the Stock Solution (the volume in uL $V_c$ recorded) to successive 20 mL headspace vials containing 0.1±0.001 grams of an untreated control tissue sheet. The solvent is evaporated by placing the headspace vials in an oven at a temperature ranging between about 60° C. to about 70° C. for about 15 minutes. The μg of emulsion (represented as Z) for each calibration standard is calculated from the following equation:

$$Z=Vc*Y/1000$$

Analytical Procedure

The calibration standards are then analyzed according to the following procedure: 0.100±.0.001 g sample of a tissue sheet is weighed to the nearest 0.1 mg into a 20-ml headspace vial. The sample weight (represented as $W_s$) in mg is recorded. The amount of tissue sheet taken for the standards and samples must be the same.

100 μL of $BF_3$ reagent is added to each of the tissue sheet samples and calibration standards. Each vial is sealed immediately after adding the $BF_3$ reagent.

The sealed vials are placed in the headspace autosampler and analyzed using the conditions described previously, injecting 1 mL of the headspace gas from each tissue sheet sample and calibration standard.

Calculations

A calibration curve of μg emulsion versus analyte peak area is prepared.

The analyte peak area of the tissue sheet sample is then compared to the calibration curve and amount of polydimethylsiloxane emulsion (represented as (A)) in μg on the tissue sheet determined.

The amount of polydimethylsiloxane emulsion (represented as (C)) in percent by weight on the tissue sample is computed using the following equation:

$$(C)=(A)/(W_s*10^4)$$

The amount of the polydimethyl siloxane (represented as (D)) in percent by weight on the tissue sheet sample is computed using the following equation:

$$(D)=(C)/100$$

Basis Weight Determination (Tissue)

The basis weight and bone dry basis weight of the tissue sheet specimens was determined using a modified TAPPI T410 procedure. As is basis weight samples were conditioned at 23° C.±1° C. and 50±2% relative humidity for a minimum of 4 hours. After conditioning a stack of 16—3"×3" samples was cut using a die press and associated die. This represents a tissue sheet sample area of 144 $in^2$. Examples of suitable die presses are TMI DGD die press manufactured by Testing Machines, Inc. located at Islandia, N.Y., or a Swing Beam testing machine manufactured by USM Corporation, located at Wilmington, Mass. Die size tolerances are +/−0.008 inches in both directions. The specimen stack is then weighed to the nearest 0.001 gram on a tared analytical balance. The basis weight in pounds per 2880 $ft^2$ is then calculated using the following equation:

$$\text{Basis weight=stack wt. In grams}/454*2880$$

The bone dry basis weight is obtained by weighing a sample can and sample can lid to the nearest 0.001 grams (this weight is A). The sample stack is placed into the sample can and left uncovered. The uncovered sample can and stack along with sample can lid is placed in a 105° C.±2° C. oven for a period of 1 hour±5 minutes for sample stacks weighing less than 10 grams and at least 8 hours for sample stacks weighing 10 grams or greater. After the specified oven time has lapsed, the sample can lid is placed on the sample can and the sample can removed from the oven. The sample can is allowed to cool to approximately ambient temperature but no more than 10 minutes. The sample can, sample can lid, and sample stack are then weighed to the nearest 0.001 gram (this weight is C). The bone dry basis weight in pounds/2880 $ft^2$ is calculated using the following equation:

$$\text{Bone Dry } BW=(C-A)/454*2880$$

Dry Tensile (Tissue)

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0 C.±1.0° C., 50.0±2.0% relative humidity, and after the tissue sheet has equilibrated to the testing conditions for a period of not less than four hours. Testing is conducted on a tensile testing machine maintaining a constant rate of elongation, and the width of each specimen tested was 3 inches. The "jaw span" or the distance between the jaws, sometimes referred to as gauge length, is 2.0 inches (50.8 mm). The crosshead speed is 10 inches per minute (254 mm/min.) A load cell or full-scale load is chosen so that all peak load results fall between 10 and 90 percent of the full-scale load. In particular, the results described herein were produced on an Instron 1122 tensile frame connected to a Sintech data acquisition and control system utilizing IMAP software running on a "486 Class" personal computer. This data system records at least 20 load and elongation points per second. A total of 10 specimens per sample are tested with the sample mean being used as the reported tensile value. The geometric mean tensile is calculated from the following equation:

$$GMT=(MD\ \text{Tensile}*CD\ \text{Tensile})^{1/2}$$

To account for small variations in basis weight, GMT values were then corrected to the 18.5 pounds/2880 $ft^2$ target basis weight using the following equation:

$$\text{Corrected } GMT=\text{Measured } GMT*(18.5/\text{Bone Dry Basis Weight})$$

Wet Out Time

The Wet Out Time of a tissue sheet treated in accordance with the present invention is determined by cutting 20 sheets of the tissue sheet sample into 2.5 inch squares. The number of sheets of the tissue sheet sample used in the test is independent of the number of plies per sheet of the tissue sheet sample. The 20 square sheets of the tissue sheet sample are stacked together and stapled at each corner to form a pad of the tissue sheet sample. The pad of the tissue sheet sample is held close to the surface of a constant temperature distilled water bath (23° C.±2° C.), which is the appropriate size and depth to ensure the saturated pad of the tissue sheet sample does not contact the bottom of the water bath container and the top surface of the distilled water of the water bath at the same time, and dropped flat onto the surface of the distilled water, with staple points on the pad of the tissue sheet sample facing down. The time necessary for the pad of the tissue sheet sample to become completely saturated, measured in seconds, is the Wet Out Time for the tissue sheet sample and represents the absorbent rate of the tissue sheet sample. Increases in the Wet Out Time represent a decrease in absorbent rate of the tissue sheet sample. The test is stopped at 300 seconds with any sheet not wetting out in that period given a value of about 300 seconds or greater.

Hercules Size Test

Hercules size testing was done in general accordance with TAPPI method T 530 PM-89, Size Test for Paper with Ink Resistance. Hercules Size Test data was collected on a Model HST tester using white and green calibration tiles and the black disk provided by the manufacturer. A 2% Napthol Green N dye diluted with distilled water to 1% was used as the dye. All materials are available from Hercules, Inc., located at Wilmington, Del.

All specimens were conditioned for at least 4 hours at 23° C.±1° C. and 50±2% relative humidity prior to testing. The test is sensitive to dye solution temperature so the dye solution should also be equilibrated to the controlled condition temperature for a minimum of 4 hours before testing.

6 tissue sheets (12 plies for a 2-ply product, 18 plies for a 3-ply product, etc.) are selected for testing. The tissue sheet specimens are cut to an approximate dimension of 2.5×2.5 inches. The instrument is standardized with white and green calibration tiles per manufacturer's directions. The tissue sheet specimen (12 plies for a 2-ply product) is placed in the sample holder with the outer surface of the tissue sheets facing outward. The tissue sheet specimen is then clamped into the specimen holder. The specimen holder is then positioned in the retaining ring on top of the optical housing. Using the black disk the instrument zero is calibrated. The black disk is removed and 10±0.5 milliliters of dye solution is dispensed into the retaining ring and the timer started while placing the black disk back over the specimen. The test time in seconds is recorded from the instrument.

Caliper

The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up. Caliper is expressed in microns. Caliper was measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals).

Determination of Fiber Length

The length weighted average pulp fiber length and the average pulp fiber length was determined with a fiber length analysis instrument. Specifically, an Optest Fiber Quality Analyzer LDA96 instrument (hereinafter referred to as the 'analyzer instrument') was used. The pulp fibers were prepared for the analyzer instrument by first disintegrating the pulp fibers in a British Pulp Disintegrator for about 5 minutes at low consistency (less than 3%). The analyzer instrument is available from Lorentzen and Werte, Inc., located in Atlanta, Ga. The pulp fibers are sufficiently diluted to allow the analyzer instrument to analyze between 10 and 20 particles, or in this case, pulp fibers, per second. The settings on the analyzer instrument limits the data used in the calculation to projections between about 0.2 mm and about 10 mm. Anything below or above the predetermined length range is not factored into length weighted average values. The length data for each counted particle or pulp fiber are then used to calculate the length weighted average pulp fiber length of the sample using the following equation:

$$Lw = \frac{\sum n_i L_i^2}{\sum n_i L_i}$$

Wherein:

Lw=length weighted average fiber length $N_i$=number of fibers in the "i"th length category $L_i$=contour length of the fiber in the "i"th length category Sensory Softness Sensory softness is an assessment of tissue sheet in-hand feel softness. This panel is lightly trained so as to provide assessments closer to those a consumer might provide. The strength lies in its generalizability to the consumer population. This softness measure is employed when the purpose is to obtain a holistic overview of attributes of the tissue sheets and to determine if differences in the tissue sheets are humanly perceivable.

The following is the specific softness procedure the panelists utilize while evaluating sensory softness for bath, facial and towel products. Samples of tissue sheets or tissue products are placed across the non-dominant arm with the coded side facing up. The pads of the thumb, index, and middle fingers of the dominant hand are then moved in a circular motion lightly across several areas of the sample. The velvety, silky, and fuzzy feel of the samples of the tissue sheets or tissue products is evaluated. Both sides of the samples are evaluated in the same manner. The procedure is then repeated for each additional sample. The samples are then ranked by the analyst from least to most soft.

The sensory softness data results are analyzed using a Freidman Two-Way Analysis of Variance (ANOVA) by Ranks. This analysis is a non-parametric test used for ranking data. The purpose is to determine if there is a difference between different experimental treatments. If there is not a ranking difference between the different experimental treatments, it is reasoned that the median response for one treatment is not statistically different than the median response of the other treatment, or any difference is caused by chance.

Sensory softness is assessed by between 10 to 12 panelists applying a rank order paradigm with no replications. For each individual attribute, approximately 24–72 data points are generated. A maximum of six codes may be ranked at one time. More codes may be assessed in multiple studies; however, a control code should be present in each study to provide a common reference if codes are to be compared across multiple studies.

Sensory softness is employed when it is desirable to obtain a holistic assessment of softness or to determine if sample differences are humanly perceivable. This panel is gently trained to provide assessments closer to those a consumer might provide. Sensory softness is useful for obtaining a read as to whether a sample change is humanly detectable and/or affects the softness perception. The data from the (IHR) is presented in rank format. Therefore, the data may be used to make relative comparisons within a study as a sample's ranking is dependent upon the samples it is ranked with. As discussed above, test comparisons may be made across multiple studies as long at least one sample is tested in all the studies. A control code also is used to provide some a link across multiple studies.

Sensory softness has been validated to consumer acceptance based on a Central Location Test (CLT) of bath and facial tissue. A sight and handling test was executed in major cities throughout the U.S, employing 450 consumers. The consumers assessed 15 bath and 15 facial tissues sheets for preference on 10 attributes including overall acceptance, softness, and strength. The IHR assessed the same tissue sheets utilizing assessments of softness and strength. IHR attributes were found to correlate with consumer acceptance of bath and facial tissue products.

EXAMPLES

For all examples, the selectively treated pulp fiber was made in general accordance with the following procedure. Fully bleached eucalyptus hardwood kraft pulp fibers were prepared into a pulp fiber slurry having a pH value of about 4.5. The pulp fiber slurry was formed into a pulp fiber mat at a basis weight of about 900 g/m$^2$. The pulp fiber mat was pressed and dried to approximately about 85% solids. A neat polydimethylsiloxane, Q2-8220 commercially available from Dow Corning, located at Midland, Mich., was applied via a modified size press to both sides of the pulp fiber web. The amount of polysiloxane applied to the pulp fiber mat was about 1.5% by weight of total bone dry pulp fiber in the pulp fiber web. The pulp fiber web was then dried further to about 95% solids or greater before being processed into rolls or bales. The amount of polysiloxane on the eucalyptus hardwood kraft pulp fibers was determined in accordance with the analytical gas chromatography method previously described. Q2-8220 is found to have a substantivity of about 75% or greater when applied as selectively treated pulp fibers and less than about 15% when applied directly in the wet end of the tissue making process.

Examples 1–3 illustrate the preparation of a two layer two ply tissue product comprising selectively treated pulp fibers.

Example 1

The tissue sheet was manufactured according to the following procedure. About 60 pounds of polysiloxane selectively treated eucalyptus hardwood kraft pulp fibers, comprising about 1.5% polysiloxane, were dispersed in a pulper for about 30 minutes, forming a polysiloxane selectively treated eucalyptus hardwood kraft pulp fiber slurry having a consistency of about 3%. The polysiloxane selectively treated eucalyptus hardwood kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber and northern softwood kraft pulp fiber slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 65% eucalyptus hardwood kraft pulp fibers in the dryer side layer and about 35% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15% to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a slower speed than the Yankee dryer by a ratio of 1:1.3, thereby providing the layered tissue sheet.

An aqueous creping composition was prepared comprising about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of approximately 0.25 g solids/$m^2$ of product. The finished layered tissue sheet was then converted into a 2-ply c-folded tissue product with the dryer side layer of each ply facing outward. The tissue product was analyzed for wet out times. The total % polysiloxane in the sample of the tissue product is about 1.0% by weight of total pulp fiber. The tissue product had a wet out time of greater than about 300 seconds and a Hercules Size Test (HST) value of greater than about 300 seconds, indicating a high level of hydrophobicity in the tissue sheet and the tissue product. The % hydrophobic chemical additive gradient for the polysiloxane was about 5%.

Example 2

The tissue sheet was manufactured according to the following procedure. About 54 pounds of polysiloxane selectively treated eucalyptus hardwood kraft pulp fibers, comprising about 1.5% polysiloxane, and about 6 pounds of selectively-non-treated LL-19 northern softwood kraft pulp fibers (pulp fibers not selectively treated with polysiloxane) were dispersed in a pulper for about 30 minutes, forming an eucalyptus hardwood kraft pulp fiber/northern softwood kraft pulp fiber slurry having a consistency of about 3%. The eucalyptus hardwood kraft pulp fiber/northern softwood kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber/northern kraft pulp fiber and northern softwood kraft pulp slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 35% eucalyptus hardwood kraft pulp fibers in the dryer side layer and about 65% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.5% by weight of total pulp fiber. The tissue product had a wet out time of about 225 seconds and a Hercules Size Test (HST) value of about 29.8 seconds, indicating a significantly lower level of hydrophobicity in the tissue sheet and the tissue product compared to Example 1 containing the same level of polysiloxane. The % hydrophobic chemical additive gradient for the polysiloxane was about 42.7%.

Example 3

A two ply creped facial tissue product was made in accordance with Example 5 except that about 77.5 grams of an 80% solution of a cationic oleylimidazoline debonder, Prosoft TQ-1003, commercially available from Hercules, Inc., was added to the 60 pounds of pulp fiber (about 54 pounds of polysiloxane selectively treated eucalyptus hardwood kraft pulp fibers, containing about 1.5% polysiloxane, and about 6 pounds of selectively non-treated LL-19 northern softwood kraft pulp fibers (pulp fibers not selectively treated with polysiloxane)) in the machine chest. Total concentration of debonder in the layer was about 5 pounds/metric ton of dry pulp fiber and about 1.75 pounds per metric ton of dry pulp fiber in the tissue product. The wet out time of the tissue product was about 147 seconds and HST value of the tissue product was found to be about 18.4 seconds.

Sensory softness was evaluated on all codes in the examples. In all cases, the codes comprising the polysiloxane selectively treated pulp fibers were rated as being significantly softer than the corresponding control code not comprising the polysiloxane selectively treated pulp fibers.

Table 1 summarizes the data. Examples 1–3 are examples of the present invention. The selectivity of the polysiloxane (hydrophobic chemical additive) to the short pulp fibers was shown.

TABLE 1

| Example | % PDMS on Short Fibers | % PDMS on Long Fibers | Ratio of PDMS in short fraction to PDMS in long fraction |
|---|---|---|---|
| 1 | 1.35 | 0.15 | 9.0 |
| 2 | 0.5 | 0.10 | 5.0 |
| 3 | 0.52 | 0.08 | 6.5 |
| Puffs ES | 0.54 | 0.46 | 1.2 |
| Puffs | 0.1 | 0.1 | 1.00 |
| Kleenex Ultra | 1.06 | 0.94 | 1.1 |

Various codes of the examples were selected for XPS analysis of silicone. Table 2 summarizes the data. Table 2 shows the ability of the selectively treated pulp fibers to be incorporated into a tissue sheet in a manner that reduces the z-direction penetration of polysiloxane on the surface of the tissue sheet. The last two entries in Table 2 are commercially available tissue products containing polysiloxane for comparative purposes.

TABLE 2

| Example | % Atomic % Si Outside Face | % Atomic Si Inside Face | % Si Gradient |
|---|---|---|---|
| 1 | 14.1 | 13.4 | 5.0 |
| 2 | 5.2 | 2.2 | 57.6 |
| 3 | 12.4 | 7.1 | 42.7 |
| Puffs ES | 10.3 | 8.7 | 15.5 |
| Kleenex Ultra | 20.9 | 18.8 | 11.0 |

We claim:

1. A tissue product comprising at least one tissue sheet having a first side and an opposing second side, wherein said tissue sheet comprises selectively treated pulp fibers treated with at least one hydrophobic chemical additive having a wet end chemical substantivity of about 50% or less, said selectively treated pulp fibers being distributed non-uniformly within the z-direction of the tissue sheet such that the tissue sheet has a % z-directional hydrophobic chemical additive gradient of about 20% or greater.

2. The tissue product of claim 1 wherein the tissue sheet consists of two layers, wherein the selectively treated pulp fibers are contained within one of the two layers.

3. The tissue product of claim 2 wherein the selectively treated fibers are short fibers having a length of about 1.00 mm or less.

4. The tissue product of claim 2 wherein the selectively treated fibers are long fibers having a length of about 1.50 mm or greater.

5. The tissue product of claim 1 wherein the tissue sheet consists of two outer layers and one or more inner layers, wherein the selectively treated fibers are located in one or more inner layers of the sheet.

6. The tissue product of claim 5 wherein the selectively treated fibers are short fibers having a length of about 1.00 mm or less.

7. The tissue product of claim 5 wherein the selectively treated fibers are long fibers having a length of about 1.50 mm or greater.

8. The tissue product of claim 1 wherein the tissue sheet consists of two outer layers and one or more inner layers, wherein the selectively treated fibers are located in one or both outer layers of the sheet.

9. The tissue product of claim 8 wherein the selectively treated fibers are only located in one outer layer.

10. The tissue product of claim 8 wherein the selectively treated fibers are located in both outer layers.

11. The tissue product of claim 8 wherein the selectively treated fibers are short fibers having a length of about 1.00 mm or less.

12. The tissue product of claim 8 wherein the selectively treated fibers are long fibers having a length of about 1.50 mm or greater.

13. The tissue product of claim 1 wherein the hydrophobic chemical additive has a wet end substantivity of about 40% or less.

14. The tissue product of claim 1 wherein the hydrophobic chemical additive has a wet end substantivity of about 30% or less.

15. The tissue product of claim 1 wherein the hydrophobic chemical additive has a water solubility of about 3 g/100 cc or less in deionized water.

16. The tissue product of claim 1 wherein the total weight of the selectively treated pulp fibers relative to the total weight of the tissue sheet comprising the selectively treated pulp fibers ranges from about 0.5% to about 90% on a dry fiber basis.

17. The tissue product of claim 1 wherein the amount of the hydrophobic chemical additive on the selectively treated pulp fibers ranges from about 0.01 to about 10% by weight of the dry selectively treated pulp fibers.

18. The tissue product of claim 1 wherein the amount of the hydrophobic chemical additive within the tissue sheet comprising the selectively treated pulp fibers ranges from about 0.01 to about 5% by weight of the total dry fiber weight of the tissue sheet.

19. The tissue product of claim 1 having a bulk of about 2 $cm^3/g$ or greater.

20. The tissue product of claim 1 wherein the hydrophobic chemical additive is selected from the group consisting of polysiloxanes, mineral oils, aloe vera oil and extracts, tocopherols and polypropylene glycols.

21. The tissue product of claim 1 consisting of a single ply.

22. The tissue product of claim 1 having two or more plies.

23. The tissue product of claim 19 wherein all plies comprise selectively treated fibers.

24. A method of making a tissue sheet that comprises a first side, an opposing second side, and selectively treated pulp fibers treated with at least one hydrophobic chemical additive comprising:

(a) forming a first aqueous suspension of pulp fibers comprising pulp fibers selectively treated with at least one hydrophobic chemical additive having a wet end chemical substantivity of about 50% or less;

(b) forming at least a second aqueous suspension of pulp fibers wherein the second aqueous suspension of pulp fibers comprise selectively non-treated pulp fibers;

(c) depositing the first and second aqueous suspensions of pulp fibers onto a forming fabric to form a wet layered tissue sheet; and (d) dewatering the wet layered tissue sheet to form a dewatered layered tissue sheet, wherein the selectively treated pulp fibers are distributed non-uniformly in the z-direction within the tissue sheet such that the tissue sheet has a % z-directional hydrophobic chemical additive gradient of about 20% or greater.

25. The method of claim 24 wherein the hydrophobic chemical additive has a wet end chemical substantivity of about 40% or less.

26. The method of claim 24 wherein the hydrophobic chemical additive has a wet end chemical substantivity of about 30% or less.

27. The method of claim 24 further comprising forwarding the first aqueous suspension of pulp fibers to a stratified headbox having two layers such that the first aqueous suspension of pulp fiber is directed to one of the two layers of the stratified headbox.

28. The method of claim 24 further comprising forwarding the second aqueous suspension or pulp fibers to the other layer of the stratified headbox.

29. The method of claim 24 further comprising forwarding the first aqueous suspension of pulp fibers to a stratified headbox having two outer layers and one or more inner layers, wherein the first aqueous suspension of pulp fiber is directed to one or both of the two outer layers of the stratified headbox.

30. The method of claim 24 wherein the first aqeous suspension of pulp fibers is directed to both outer layers and the second aqueous suspension of pulp fibers is directed to one or more inner layers.

31. The method of claim 24 wherein the first aqueous suspension of pulp fibers is directed to only one outer layer and the second aqueous suspension of pulp fibers is directed to the other outer layer and one or more inner layers.

32. The method of claim 24 wherein the first aqueous suspension of pulp fibers is directed to one or more inner layers and the second aqueous suspension of pulp fibers is directed to one or both outer layers.

33. The method of claim 24 wherein the hydrophobic chemical additive is delivered to the selectively treated pulp fibers as a neat hydrophobic chemical additive or as a neat mixture of hydrophobic chemical additives.

34. The method of claim 24 wherein at least one of the hydrophobic chemical additive has a water solubility of about 3 g/100 cc or less in deionized water.

35. The method of claim 24 wherein the total weight of the selectively treated pulp fibers relative to the total weight of the pulp fibers of the tissue sheet ranges from about 0.5 to about 90% on a dry fiber basis.

36. The method of claim 24 wherein the amount of the hydrophobic chemical additive on the selectively treated pulp fibers ranges from about 0.01 to about 10% by weight of the dry selectively treated pulp fibers.

37. The method of claim 24 wherein the amount of the hydrophobic chemical additive on the selectively treated pulp fibers ranges from about 0.01 to about 5% by weight of the dry selectively treated pulp fibers.

38. The method of claim 24 wherein the hydrophobic chemical additive is selected from the group consisting of polysiloxanes, mineral oils, aloe vera oil and extracts, tocopherols and polypropylene glycols.

39. The method of claim 24 wherein the wherein the first aqueous suspension of pulp fibers further comprise selectively non-treated pulp fibers.

40. The method of claim 24 wherein the wherein the first and second aqueous suspensions of pulp fibers are be deposited onto the forming fabric such that a layer of the selectively treated pulp fibers of the first aqueous suspension of pulp fibers is adjacent to a layer of the selectively non-treated pulp fibers of the second aqueous suspension of pulp fibers.

* * * * *